US007974837B2

(12) United States Patent
Tanaka

(10) Patent No.: US 7,974,837 B2
(45) Date of Patent: Jul. 5, 2011

(54) AUDIO ENCODING APPARATUS, AUDIO DECODING APPARATUS, AND AUDIO ENCODED INFORMATION TRANSMITTING APPARATUS

(75) Inventor: Naoya Tanaka, Osaka (JP)

(73) Assignee: Panasonic Corporation, Osaka (JP)

( * ) Notice: Subject to any disclaimer, the term of this patent is extended or adjusted under 35 U.S.C. 154(b) by 865 days.

(21) Appl. No.: 11/993,395

(22) PCT Filed: Jun. 21, 2006

(86) PCT No.: PCT/JP2006/312390

§ 371 (c)(1),
(2), (4) Date: Dec. 20, 2007

(87) PCT Pub. No.: WO2006/137425

PCT Pub. Date: Dec. 28, 2006

(65) Prior Publication Data

US 2010/0100390 A1 Apr. 22, 2010

(30) Foreign Application Priority Data

Jun. 23, 2005 (JP) ..... 2005-184086

(51) Int. Cl.
*G10L 11/04* (2006.01)

(52) U.S. Cl. ..... 704/207; 704/203

(58) Field of Classification Search ..... 704/203, 704/207, 500–504

See application file for complete search history.

(56) References Cited

U.S. PATENT DOCUMENTS 4,091,242 A 5/1978 Carrubba et al.
5,524,172 A * 6/1996 Hamon ..... 704/268
5,630,013 A 5/1997 Suzuki et al.
5,731,767 A * 3/1998 Tsutsui et al. ..... 341/50
5,809,454 A 9/1998 Okada et al.
5,819,212 A * 10/1998 Matsumoto et al. ..... 704/219
5,926,788 A 7/1999 Nishiguchi
6,115,687 A 9/2000 Tanaka et al.

(Continued)

FOREIGN PATENT DOCUMENTS

EP 0 608 833 8/1994

(Continued)

OTHER PUBLICATIONS

International Search Report issued Sep. 26, 2006 in the International (PCT) Application of which the present application is the U.S. National Stage.

(Continued)

*Primary Examiner* — Abul Azad
(74) *Attorney, Agent, or Firm* — Wenderoth, Lind & Ponack, L.L.P.

(57) ABSTRACT

The encoding apparatus includes an MDCT unit which transforms an inputted audio signal into a frequency parameter, for every predetermined time-frequency transformation frame length, and an MDCT coefficient encoding unit which encodes the frequency parameter. The encoding apparatus also includes a pitch cycle detection unit which detects a pitch cycle of the audio signal, a framing unit which frames the audio signal based on the detected pitch cycle, and a waveform modification unit which performs waveform modification on the audio signal framed based on the pitch cycle, in conformance with the time-frequency transformation frame length, and outputs the waveform-modified audio signal to the MDCT unit. A multiplex unit multiplexes the frequency parameter encoded by MDCT coefficient encoding unit and the pitch cycle, and outputs the multiplexed result as a bitstream.

19 Claims, 20 Drawing Sheets

U.S. PATENT DOCUMENTS

| | | | | |
|---|---|---|---|---|
| 6,141,637 | A * | 10/2000 | Kondo | 704/204 |
| 6,351,730 | B2 * | 2/2002 | Chen | 704/229 |
| 6,785,644 | B2 * | 8/2004 | Koyanagi | 704/215 |
| 2004/0122662 | A1 * | 6/2004 | Crockett | 704/200.1 |
| 2004/0196988 | A1 | 10/2004 | Moulios et al. | |
| 2006/0167690 | A1 | 7/2006 | Sato | |

FOREIGN PATENT DOCUMENTS

| | | |
|---|---|---|
| EP | 0 751 493 | 1/1997 |
| EP | 0 883 106 | 12/1998 |
| EP | 1 610 300 | 12/2005 |
| JP | 2-7100 | 1/1990 |
| JP | 9-6397 | 1/1997 |
| JP | 9-73299 | 3/1997 |
| JP | 3147562 | 1/2001 |
| JP | 2004/088634 | 10/2004 |
| JP | 2004-294969 | 10/2004 |
| WO | 98/21710 | 5/1998 |

OTHER PUBLICATIONS

ISO/IEC 14496-3:2001, pp. 1-314.

John P. Princen and Alan Bernard Bradley, "*Analysis/Synthesis Filter Bank Design Based on Time Domain Aliasing Cancellation*", IEEE Transactions on Acoustics, Speech, and Signal Processing, vol. ASSP-34, No. 5, Oct. 1986, pp. 1153-1161.

Supplementary European Search Report (in English language) issued Dec. 14, 2010 in corresponding European Patent Application No. 06767049.7.

* cited by examiner

AUDIO ENCODING APPARATUS, AUDIO DECODING APPARATUS, AND AUDIO ENCODED INFORMATION TRANSMITTING APPARATUS

TECHNICAL FIELD

The present invention relates to an audio encoding apparatus, an audio decoding apparatus, and an audio encoded information transmitting apparatus, particularly to a technique for efficiently encoding an audio signal into a small amount of information while responding to changes in reproduction speed during listening, and for decoding encoded information.

BACKGROUND ART

The objective of audio encoding is compression encoding a digitalized signal as effectively as possible, transmitting the encoded signal, and reproducing an audio signal of the highest possible quality through decoding of the encoded signal by a decoder.

Various methods have been proposed as audio encoding methods, depending on the conditions such as the type of the signal to be encoded, the bit rate, and required sound quality. For example, MPEG-4 Audio which is an ISO/IEC standard specification (see Non-patent Reference 1) discloses encoding methods such as Advanced Audio Coding (AAC), Code Excited Linear Prediction (CELP), and HVXC (Harmonic Vector eXcitation Coding). In particular, the AAC method is an excellent method that can encode, with high quality (on par with compact disc audio, for example), a general audio signal that contains music, and is characterized in utilizing a time-frequency transformation called Modified Discrete Cosine Transform (MDCT). These encoding methods are widely used in communication, broadcasting, and accumulation-type audio devices.

On the other hand, in the listening/viewing of broadcast or accumulated audio or audio/video composite information, there is an increasing demand for making reproduction speed during listening/viewing variable. With the increased capacity of information accumulation means and diversification of information obtainment methods, the amount of information that can be viewed/listened to by an individual has increased dramatically. Therefore, a high-speed reproduction function for viewing/listening to more information within a limited time is important.

As a method for variable-speed reproduction of an audio signal, there is a first method which cancels and inserts a pitch waveform, based on the pitch cycle of a temporal audio signal (see Patent Reference 1), and a second method which, after the parameter transformation of an audio signal, changes the update cycle of the parameters (see Patent Reference 2). However, as a processing method for a high-quality input signal, the use of the pitch cycle-based temporal signal processing in the former is common. This is because the second method is only used in low-quality speech, and is not suitable for a high-quality signal.

An example of the configuration of an audio decoding apparatus for realizing variable-speed reproduction of an audio signal encoded using an MDCT-based audio encoding method is shown in FIG. 1.

As shown in FIG. 1, a decoding apparatus 9000 includes a bitstream separation unit 9901, an MDCT coefficient decoding unit 9902, an inverse MDCT unit 9903, a pitch analyzing unit 9904, a reproduction speed control unit 9905, a waveform modification unit 9906, and a waveform connecting unit 9907.

An input bitstream 9908 is separated into respective code elements by the bitstream separation unit 9901. An MDCT code 9909, which is a code element required in decoding an MDCT coefficient, is inputted to the MDCT coefficient decoding unit 9902, and an MDCT coefficient 9910 is decoded. The inverse MDCT unit 9903 performs inverse-transformation on the MDCT coefficient 9910, and a temporal audio signal 9911 is generated. The pitch analyzing unit 9904 analyzes the pitch cycle of the temporal audio signal 9911. The reproduction speed control unit 9905, upon receiving a reproduction speed change instruction 9913, determines a start position 9914 for reproduction speed changing based on analyzed pitch cycle 9912. The waveform modification unit 9906 performs the modification of the waveform (waveform cancellation and insertion) based on the pitch cycle 9912 at the start position 9914 for the processing, connects the modified waveform 9915, and generates an output audio signal 9916.

Furthermore, as shown (in Patent Reference 3), it is also possible to have a configuration which makes use of pitch cycle information included in the input bitstream, instead of the pitch cycle 9912 analyzed by the pitch analyzing unit 9904.

Patent Reference 1: Japanese Patent No. 3147562

Patent Reference 2: Japanese Unexamined Patent Application Publication No. 9-6397

Patent Reference 3: PCT International Patent Application Publication No. 98/21710 (Pamphlet)

Non-patent Reference 1: ISO/IEC 14496-3:2001

Non-patent Reference 2: IEEE Trans. ASSP-34 No. 5, October 1986, John P. Princen and Alan Bernard Bradley, "Analysis/Synthesis Filter Bank Design Based on Time Domain Aliasing Cancellation"

SUMMARY OF THE INVENTION

Problems that Invention is to Solve

However, in the process of variable-speed reproduction of an audio signal compressed using an audio encoding method, a configuration for performing, on the decoded audio signal, pitch cycle-based waveform insertion and cancellation in a temporal region is conventionally adopted.

For this reason, in such a conventional configuration there exists problems broadly divided into the following two.

In order to clarify these problems, the premise of the conventional technique shall be explained.

FIG. 2 is a diagram showing the overall configuration of a system used in a conventional decoding apparatus.

The system includes an encoder 9100 which performs compression encoding on an inputted audio signal (PCM), a recording medium 9200 for recording the compression-encoded audio signal, a decoder 9300 which decodes the compression-encoded audio signal, and a speed changer 9400 for variable-speed reproduction.

The decoder 9300 includes the bitstream separation unit 9901, the MDCT coefficient decoder 9902, and the inverse MDCT unit 9903 of the decoding apparatus 9000 shown in FIG. 1. Furthermore, the speed changer 9400 includes the pitch analyzing unit 9904, the reproduction speed control unit 9905, the waveform modification unit 9906, and the waveform connection unit 9907 of the decoding apparatus 9000.

For example, in the case of variable-speed reproduction at double speed, although the encoded signal is transmitted from the recording medium 9200 directly to the decoder 9300 or via antennas 9500 and 9600, such transmission speed needs to be double that of normal reproduction. Furthermore, the processing amount for the decoder 9300 and the speed changer 9400 required also becomes double that of normal reproduction.

Therefore, the conventional technique entails the following problems concerning (1) processing amount and (2) transmission information amount.

(1) Processing Amount

In order to perform the pitch waveform insertion and cancellation processing in the temporal region, the temporal signal waveform of the section to be processed is required. This indicates that in the case where the target audio signal is encoded, all the signals in that section need to be decoded.

For example, in the case of implementing double-speed reproduction, after decoding a temporal waveform that is double the length of the actual reproduction time, the temporal waveform is halved.

Therefore, the processing amount required for decoding becomes double that of normal reproduction.

In addition, when pitch waveform extraction as well as waveform insertion and cancellation are added, the processing amount further increases.

(2) Transmission Information Amount

When the target audio signal is encoded, in order to obtain the temporal signal waveform for the target section, the bitstream corresponding to that section needs to be received.

For example, in the case of implementing double-speed reproduction, twice as much bitstream is required in order to decode a temporal waveform that is double the length of the actual reproduction time.

At this time, since reproduction time is fixed in relation to the actual time, there is a need to receive the bitstream at double the normal speed.

This means that a wider band is needed for the communication path and, in the case where the communication path has a fixed bit rate, this means that (except for partial variable-speed reproduction through buffering) variable-speed reproduction is not possible.

In view of this, the present invention solves the aforementioned technical problem and has as an object to provide an audio encoding apparatus, an audio decoding apparatus, and an audio encoded information transmitting apparatus, that reduce transmission information volume, and reduce the processing amount for a decoding apparatus.

Means to Solve the Problems

In order to achieve the aforementioned object, the audio encoding apparatus according to the present invention is an audio encoding apparatus including: a time-frequency transformation unit which transforms an audio signal inputted into a frequency parameter, for every predetermined time-frequency transformation frame length; and an encoding unit which encodes the frequency parameter. The audio encoding apparatus includes: a pitch cycle detection unit which detects a pitch cycle of the audio signal; a framing unit which frames the audio signal based on the detected pitch cycle; a first waveform modification unit which performs waveform modification on the audio signal framed based on the pitch cycle, in conformance with the time-frequency transformation frame length, and outputs the waveform-modified audio signal to the time-frequency transformation unit; and a multiplex unit which multiplexes the frequency parameter encoded by the encoding unit and the pitch cycle, and outputs the multiplexed result as a bitstream.

Accordingly, the information transmission amount to the decoding apparatus during variable speed reproduction can be reduced to the same level as during uniform-speed reproduction, and the processing amount in the decoding apparatus can be reduced to the same level as in the decoding during uniform-speed reproduction.

Furthermore, the audio decoding apparatus according to the present invention is an audio decoding apparatus including: a decoding unit which decodes a frequency parameter of an encoded frame included in an inputted bitstream; and an inverse time-frequency transformation unit which performs inverse time-frequency transformation, for every predetermined time-frequency transformation frame length, so as to inverse-transform the frequency parameter into an audio signal, wherein the bitstream includes pitch cycle information indicating a pitch cycle of the audio signal, the inverse time-frequency-transformed audio signal is an audio signal which has been framed in advance based on the pitch cycle, and which has been waveform-modified in conformance with the time-frequency transformation frame length, and the audio decoding apparatus includes: a bitstream separation unit which separates pitch cycle information included in the inputted bit stream; a second waveform modification unit which modifies the audio signal of the time-frequency transformation frame length into a waveform signal of the pitch cycle length, based on the pitch cycle information; and a waveform connecting unit which connects the audio signals modified to the pitch cycle length.

Accordingly, the information transmission amount received by the decoding apparatus can be reduced to the same level as that of the normal bit rate, and the processing amount in decoding can be reduced to the same level as that in normal decoding.

Specifically, it is possible that the audio decoding apparatus according to the present invention further includes a first reproduction speed changing unit which changes a reproduction speed of an audio signal by skipping a decoding process of decoding the frequency parameter.

Accordingly, since variable-speed reproduction becomes possible by bitstream manipulation, the processing amount required for decoding is reduced. Furthermore, sine the bitstream amount required in decoding decreases, the required transmission band during variable-speed reproduction is reduced.

Furthermore, the audio encoded information transmitting apparatus according to the present invention is an audio encoded information transmitting apparatus including: a transmitting apparatus for transmitting a bitstream of an encoded audio signal; and a receiving apparatus including a decoding unit and an inverse time-frequency transformation unit, the decoding unit receiving the bitstream of the encoded audio signal and decoding a frequency parameter of an encoded frame included in the inputted bitstream, and the inverse time-frequency transformation unit performing inverse time-frequency transformation, for every predetermined time-frequency transformation frame length, so as to inverse-transform the frequency parameter into an audio signal, wherein the transmitting apparatus includes: an information storage unit which holds the bitstream of the encoded audio signal; a switch unit which turns on and off transmission of the bitstream; and a fourth reproduction speed changing unit which controls the switch unit based on an instruction for reproduction speed changing and a frame identifier included in the bitstream, the bitstream includes pitch cycle information indicating a pitch cycle of the audio signal, the inverse time-frequency transformed audio signal is an audio signal which has been framed in advance based on the pitch cycle, and which has been waveform-modified in conformance with the time-frequency transformation frame length, and the audio receiving apparatus includes: a bitstream separation unit which separates pitch cycle information included in an input bit stream; a second waveform modification unit which modifies an audio signal of a time-frequency transformation frame length into a waveform signal of a pitch cycle length, based on the pitch cycle information; and a waveform connecting unit which connects the modified audio signal of the pitch cycle length.

Accordingly, the information transmission amount received by the decoding apparatus can be reduced to the same level as that of the normal bit rate, and the processing amount in decoding in the decoding apparatus can be reduced to the same level as that in normal decoding.

Note that the present invention can be implemented not only as the audio encoding apparatus, audio decoding apparatus, and audio encoded information transmitting apparatus mentioned herein, but also as an audio encoding method, audio decoding method, and so on, which has, as steps, the characteristic units included in the audio encoding apparatus, audio decoding apparatus, and audio encoded information transmitting apparatus, and also as a program which causes a computer to execute such steps. In addition, it goes without saying that such a program can be delivered via a recording medium such as a CD-ROM and a transmission medium such as the Internet.

Effects of the Invention

As is clear from the above-mentioned description, the audio encoding apparatus, audio decoding apparatus, and audio encoded information transmitting apparatus according to the present invention, produce the effect of enabling the information transmission amount to be reduced to the same level as that of the normal bit rate, and the processing amount in decoding to be reduced to the same level as that in normal decoding.

Accordingly, with the present invention, compatibility with existing apparatuses is increased and, in the situation at present in which the amount of information that can be viewed/listened to by an individual has increased dramatically and high-speed reproduction of audio is demanded following the increased capacity of information accumulation units and diversification of information obtainment methods, the practical value of the present invention is extremely high.

NUMERICAL REFERENCES

Figure 1:
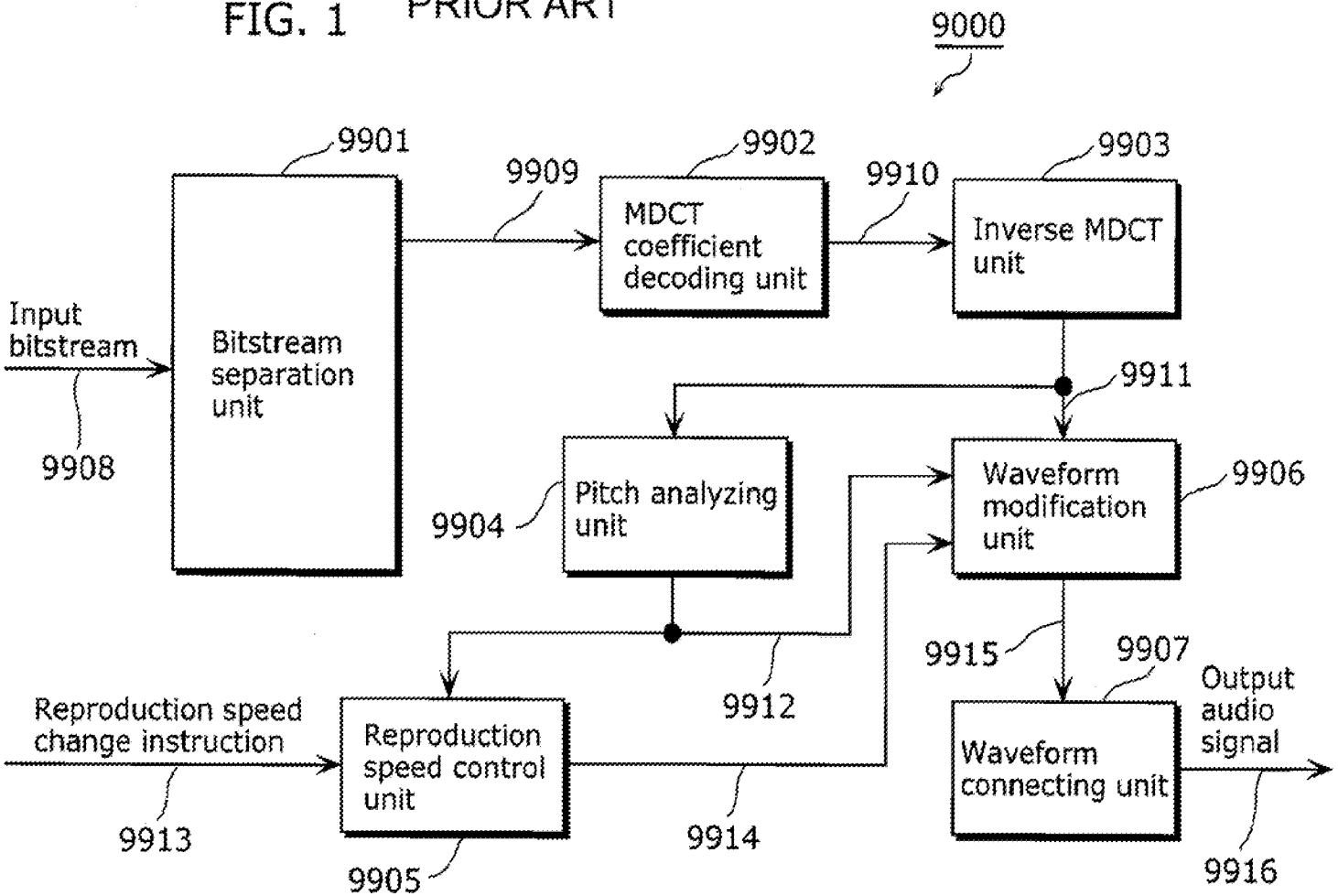
FIG. 1 PRIOR ART
FIG. 1 is a diagram showing the configuration of a conventional audio decoding apparatus.

10, 11, 12, 13 Encoding apparatus
20, 21, 22 Decoding apparatus
30 Audio encoded information transmitting apparatus
101 Framing unit
102 Pitch detection unit
103, 604, 1001, 1301 Waveform modification unit
104 MDCT unit
105 MDCT coefficient encoding unit
106 Bitstream multiplex unit
601, 1602 Bitstream separation unit
602 MDCT coefficient decoding unit
603 Inverse MDCT unit
605 Waveform connecting unit
901 Pitch adjustment unit
1302 Frame identifier generation unit
1601, 1801 Information storage unit
1603 Reproduction speed control unit
1604, 1803 Switch
1701 Buffering unit
1802 Reproduction speed control unit
1804 Transmitting apparatus
1805 Receiving apparatus

DETAILED DESCRIPTION OF THE INVENTION

Hereinafter, the embodiments of the present invention shall be described with reference to the Drawings.

First Embodiment

Figure 2:
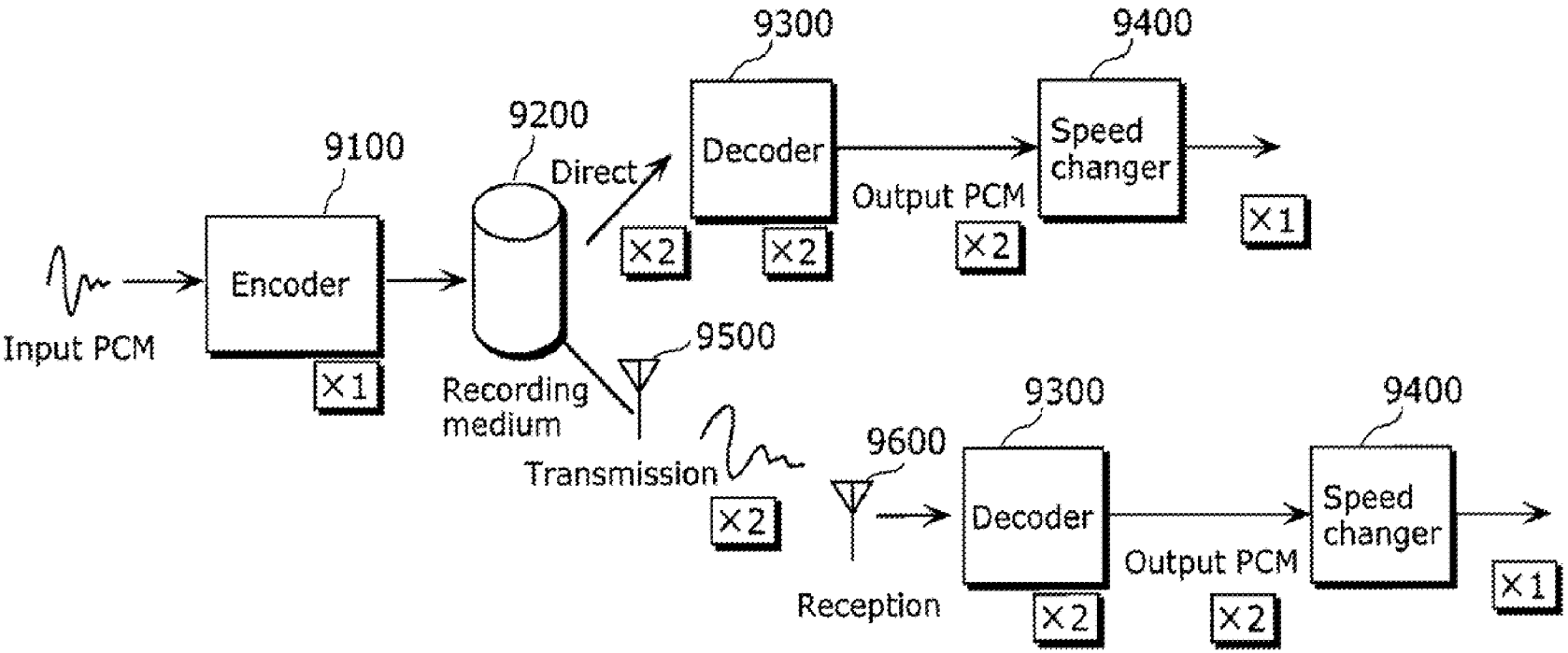
FIG. 2 PRIOR ART
FIG. 2 is a diagram showing the overall configuration of a system used in a conventional decoding apparatus.
Figure 3:
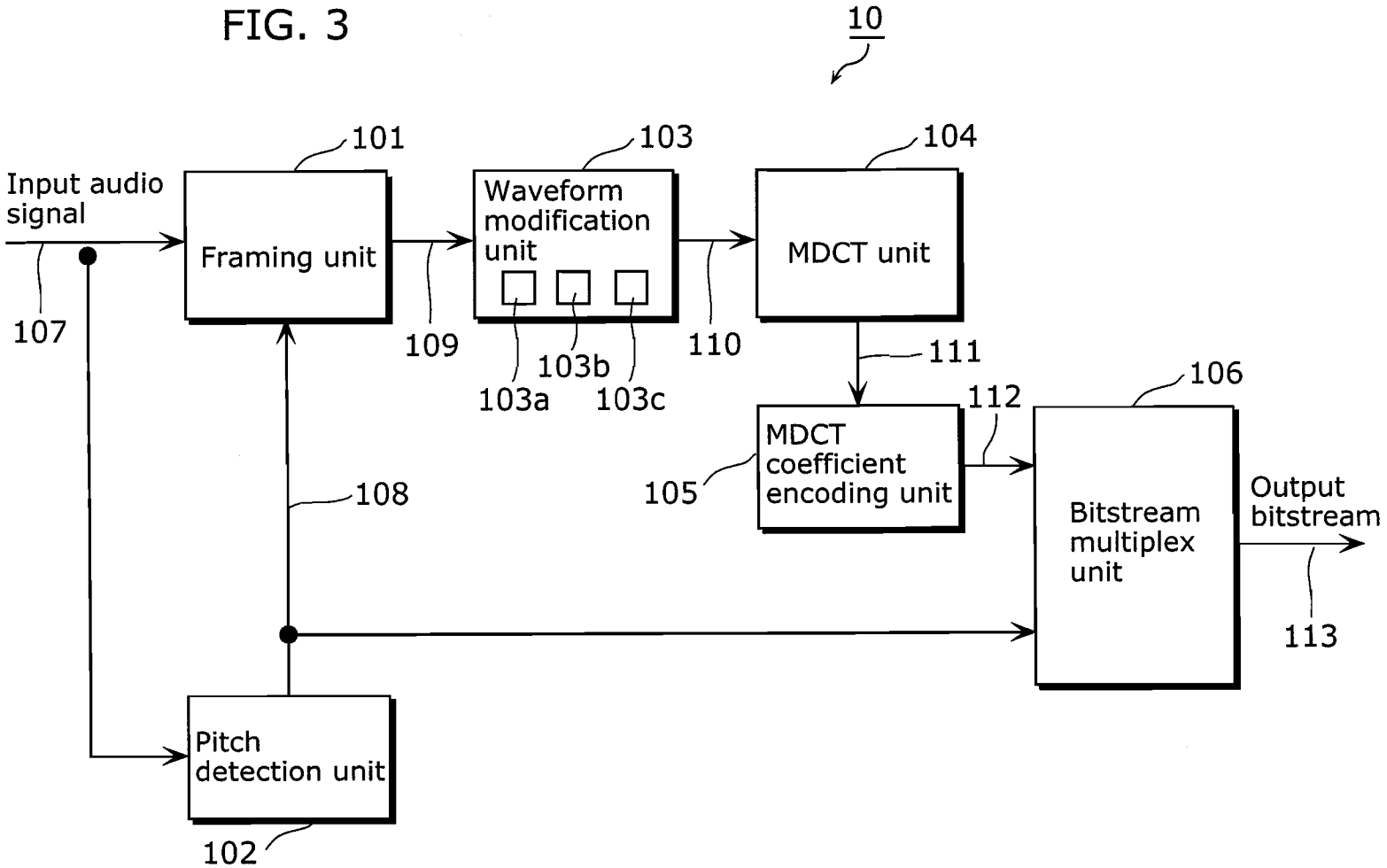
FIG. 3 is a diagram showing the configuration of the audio decoding apparatus of the present invention.

FIG. 3 is a function block diagram showing the configuration of the audio encoding apparatus in the present embodiment of the present invention. Note that the following description shows an example which uses MDCT for temporal frequency transformation. However, MDCT is an example of a transformation algorithm based on Time Domain Aliasing Cancellation (TDAC) Patent Reference 2 technology, and any temporal frequency transformation based on TDAC technology can be used in place of MDCT. In addition, encoding apparatus 10 is used in place of the encoder 9100 in the system in FIG. 2.

The encoding apparatus 10 is an apparatus which performs compression encoding on a digitalized audio signal such as PCM while modifying it in order to be able to respond to variable-speed reproduction. As shown in FIG. 3, the encoding apparatus 10 includes a framing unit 101, a pitch detection unit 102, a waveform modification unit 103, an MDCT unit 104, an MDCT coefficient encoding unit 105, and a bitstream multiplex unit 106.

Note that the wave form modification unit 103 includes: a cutting unit 103*a* which cuts an audio signal that is subjected to framing, in accordance with the pitch cycle of the audio signal; a copying unit 103*b* which generates a waveform signal having a temporal frequency transformation frame length by duplicating part of a signal waveform of an adjacent encoded frame in a current encoded frame; and a window unit 103*c* which performs windowing so that discontinuity points do not occur in the waveform signal of temporal frequency transformation frame length, generated by the copying unit 103*b*.

An input audio signal 107 is inputted to the framing unit 101 and the pitch detection unit 102.

The pitch detection unit 102 analyzes the input audio signal 107 and outputs a pitch cycle 108.

Referring to the pitch cycle 108, the framing unit 101 divides the input audio signal 107 into encoded frame signals 109 that are of pitch cycle length.

The waveform modification unit 103 modifies the encoded frame signals 109 into a form that allows MDCT transformation. Note that details of the operation of the waveform modification unit 103 shall be described later.

A modified MDCT frame signal 110 is transformed into an MDCT coefficient 111 by the MDCT unit 104.

The MDCT coefficient encoding unit 105 encodes the MDCT coefficient 111 and outputs MDCT encoded information 112.

The bitstream multiplex unit 106 multiplexes the MDCT encoded information 112 and the pitch cycle 108 and configures an output bitstream 113.

Here, although any commonly known encoding means such as vector quantization or entropy encoding can be used for the MDCT coefficient encoding unit 105, detailed description on this point is omitted as this is not the essence of the present invention.

Details of the MDCT encoded information 112 is different depending on the configuration of the MDCT coefficient encoding unit 105 that is used, and it is possible to include supplementary information for effectively encoding MDCT coefficients, aside from the code directly indicating the MDCT coefficient. For example, for the MDCT coefficient encoding unit 105, in the case of using the MPEG AAC method, scale factor information, joint stereo information, and predicted coefficient information, and so on, are included as supplementary information.

Figure 4:
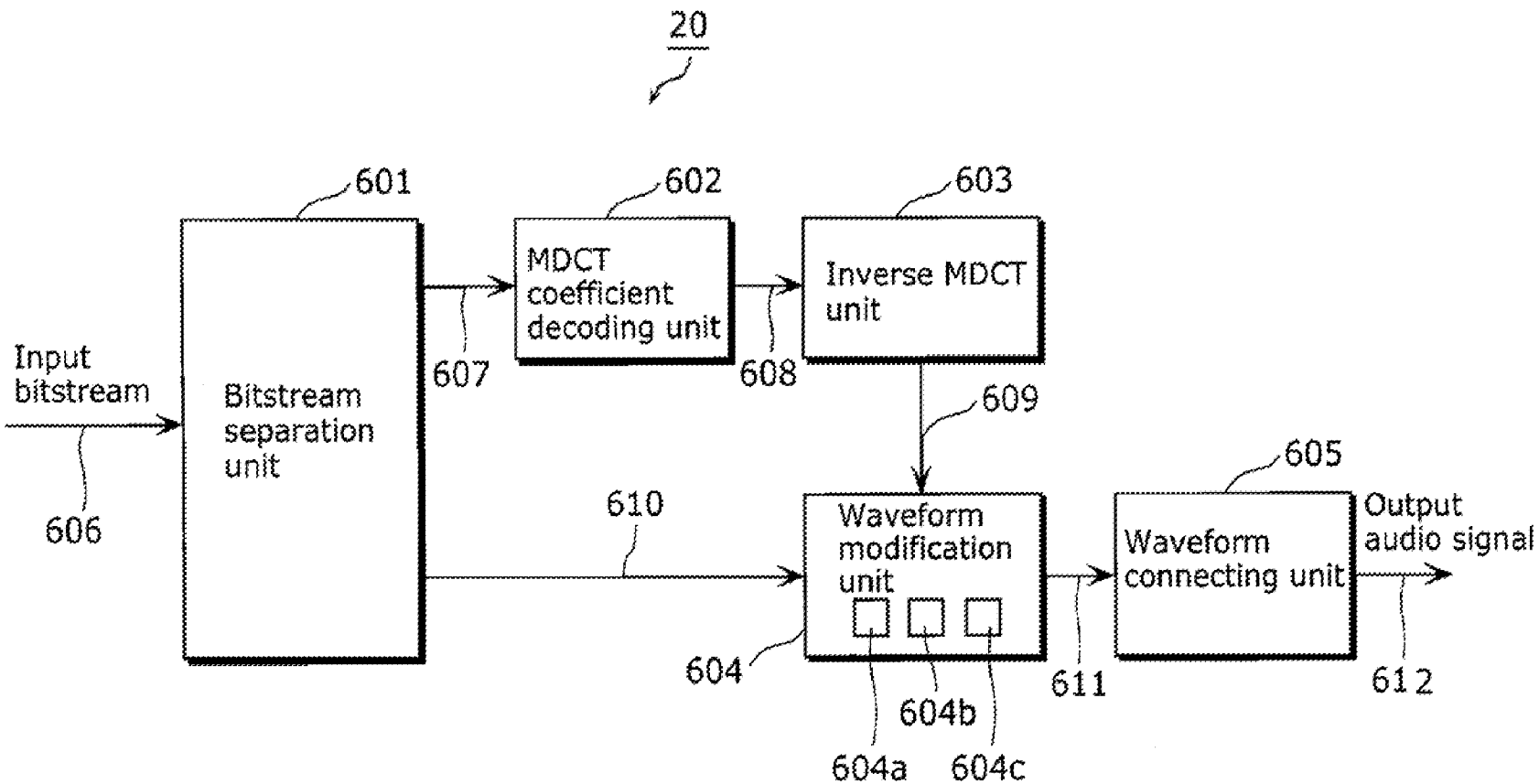
FIG. 4 is a diagram showing the configuration of the audio decoding apparatus of the present invention.

FIG. 4 is a function block diagram showing the configuration of the audio decoding apparatus of the present invention. Note that a decoding apparatus 20 is used in place of the decoder 9300 and speed changer 9400 in the system in FIG. 2.

As shown in FIG. 4, the decoding apparatus 20 includes a bitstream separation unit 601, an MDCT coefficient decoding unit 602, an inverse MDCT unit 603, a waveform modification unit 604, and a waveform connecting unit 605.

Note that the waveform modification unit 604 includes a cutting unit 604*a*, a window unit 604*b* and a connection unit 604*c*, for performing the opposite operation as the waveform modification unit 103.

The bitstream separation unit 601 separates an input bitstream 606 into an MDCT coefficient 607 and a pitch cycle 610.

The MDCT coefficient decoding unit 602 decodes the MDCT coefficient 607 to obtain an MDCT coefficient 608. Here, any commonly known decoding means can be used for the MDCT coefficient decoding unit 602, and detailed description on this point is omitted as this is not the essence of the present invention. Details of the MDCT coefficient 607 inputted to the MDCT coefficient decoding unit 602 are different depending on the configuration of the MDCT coefficient decoding unit 602 that is used, and it is possible to include supplementary information for effectively decoding MDCT coefficients, aside from the code directly indicating the MDCT coefficient. For example, for the MDCT coefficient decoding unit 602, in the case of using the MPEG AAC method, scale factor information, joint stereo information, and predicted coefficient information, and so on, are included as supplementary information.

The inverse MDCT unit 603 inverse-transforms an MDCT coefficient 608 to obtain a frame decoded signal 609.

The waveform modification unit 604 modifies the frame decoded signal 609 with reference to the pitch cycle 610, and outputs a modified frame decoded signal 611. Details of the operation of the waveform modification unit 604 shall be described later.

The waveform connecting unit 605 connects the modified frame decoded signal 611, and generates an output audio signal 612.

Next, the operation of the waveform modification unit 103 of the encoding apparatus 10 shall be described in detail. First, however, MDCT transformation (inverse MDCT transformation), which is a prerequisite for processing, and its characteristics shall be explained.

Figure 5:
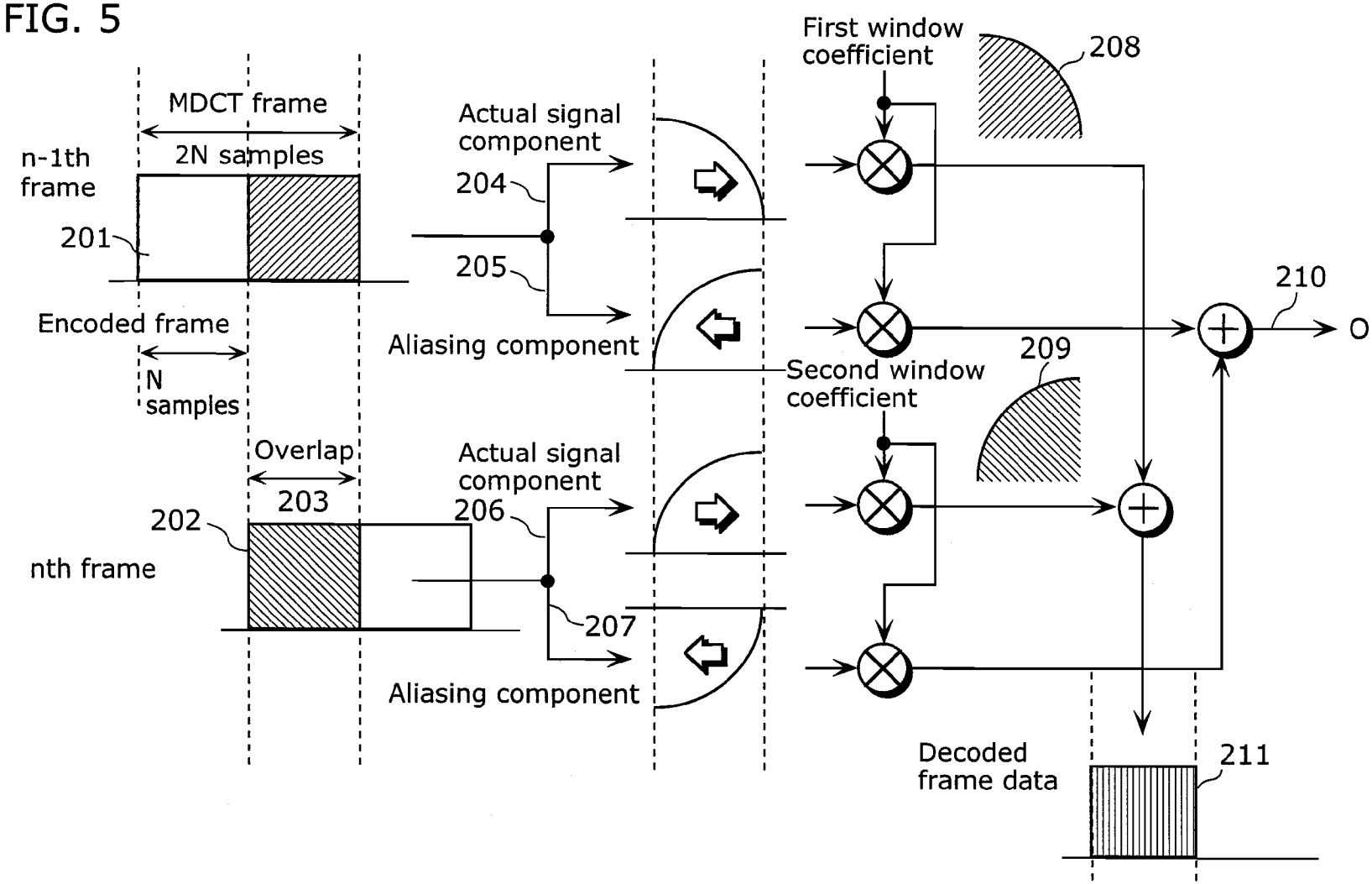
FIG. 5 is a diagram showing the principle of MDCT.

FIG. 5 is a diagram showing the decoding principle for MDCT.

MDCT is based on the technique known as TDAC and, by performing overlapping in the temporal signals between adjacent encoded frames, performs aliasing cancellation on the temporal signal.

In FIG. 5, 201 and 202 indicate the waveform signal of the MDCT frame of an $n-1^{th}$ frame and an $n^{th}$ frame, respectively.

When the coded frame length is assumed as N samples, the MDCT frame length becomes 2N samples. Furthermore, between the adjacent MDCT frames, there is an overlap 203 of the N samples equivalent to half of the MDCT frame length, and this overlap portion becomes the decoded frame waveform signal. The section (last-half of the MDCT frame) equivalent to the overlap portion of the waveform signal 201 is made from an actual signal component 204 and an aliasing component 205. Likewise, the section (first-half of the MDCT frame) equivalent to the overlap portion of the waveform signal 202 is made from an actual signal component 206 and an aliasing component 207. Here, the actual signal components 204 and 206 are mutually in phase signals, whereas the aliasing components 205 and 207 are mutually opposite phase signals. After multiplying the actual signal component 204 and the aliasing component 205 by a first window coefficient 208, and the actual signal component 206 and the aliasing component 207 with a second window coefficient 209, all the signals are added.

Here, assuming the first window coefficient is f(t) and the second window coefficient is g(t), the first window coefficient 208 and the second window coefficient 209 need to satisfy expression) (1).

[Expression 1]

$$f^2(t)+g^2(t)=1\ (0\leqq t<N) \quad (1)$$

As a result of the addition, the aliasing components 205 and 207, being mutually opposite phase signals, cancel out each other and become 0, and the added portions of the actual signal components 204 and 206 become a decoded frame waveform signal 211.

As is clear from this description, in inverse MDCT transformation, for the input of the 2N samples of the $n^{th}$ MDCT frame waveform signal, the N samples equivalent to the last-half portion of the input MDCT frame becomes the output.

Next, the principle of reproduction speed changing using pitch cycle, and its commonality with MDCT transformation is shown.

Figure 6:
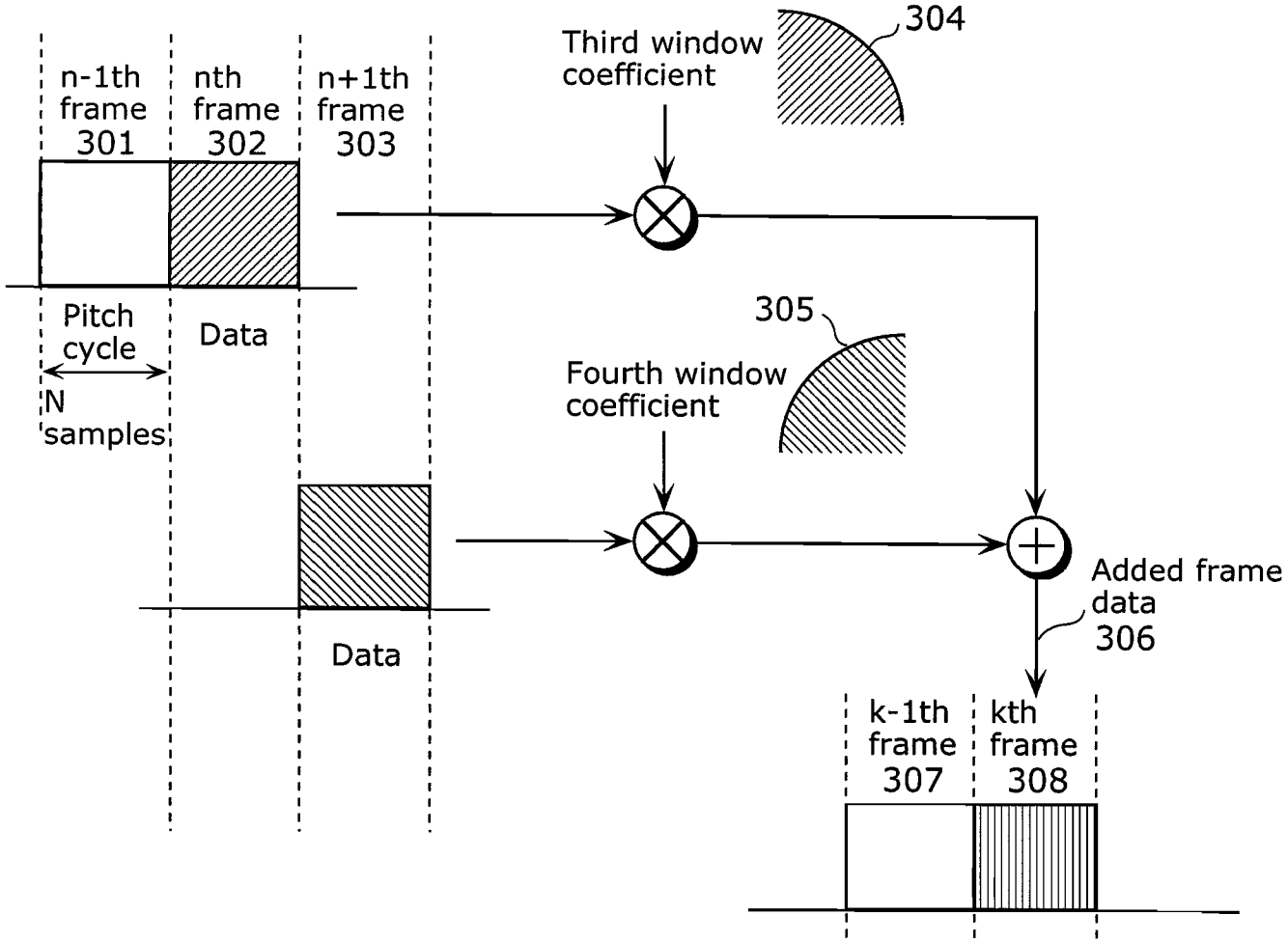
FIG. 6 is a diagram showing reproduction speed changing using pitch cycle.

FIG. 6 is a diagram showing the principle of reproduction speed changing using pitch cycle.

In FIG. 6, 301 is a waveform signal of the $n-1^{th}$ frame, 302 is a waveform signal of the $n^{th}$ frame, and 303 is a waveform signal of the $n+1^{th}$ frame, respectively. Furthermore, the length of each frame is L samples which is the pitch cycle.

By multiplying the waveform signal 302 by a third window coefficient 304 and multiplying the waveform signal 303 by a fourth window coefficient 305, and adding up the respective products, an added frame waveform signal 306 is obtained.

Here, assuming that the third window coefficient is p(t) and the fourth window coefficient is q(t), the relationship of the third window coefficient 304 and the fourth window coefficient 305 is represented by expression (2).

[Expression 2]

$$p(t)+q(t)=1\ (0\leqq t<N) \quad (2)$$

Compared with expression (1), there are no items raised to the 2nd power for the respective window coefficients. This is because, in MDCT, multiplication with the windows is performed during transformation and during inverse transformation for a total of two times, whereas in the present example multiplication is performed only once, during the speed changing process.

By assuming the waveform 301 as a waveform signal 307 of the $k-1^{th}$ frame at the output-side, and the added frame waveform signal 306 as a waveform signal 308 of the $k^{th}$ frame, the reproduction speed changing process is completed.

In this manner, it can be seen that both MDCT and pitch waveform-based reproduction speed changing make use of the overlap addition process using window coefficients.

This indicates that, reproduction speed changing is possible, using MDCT windows.

Figure 7:
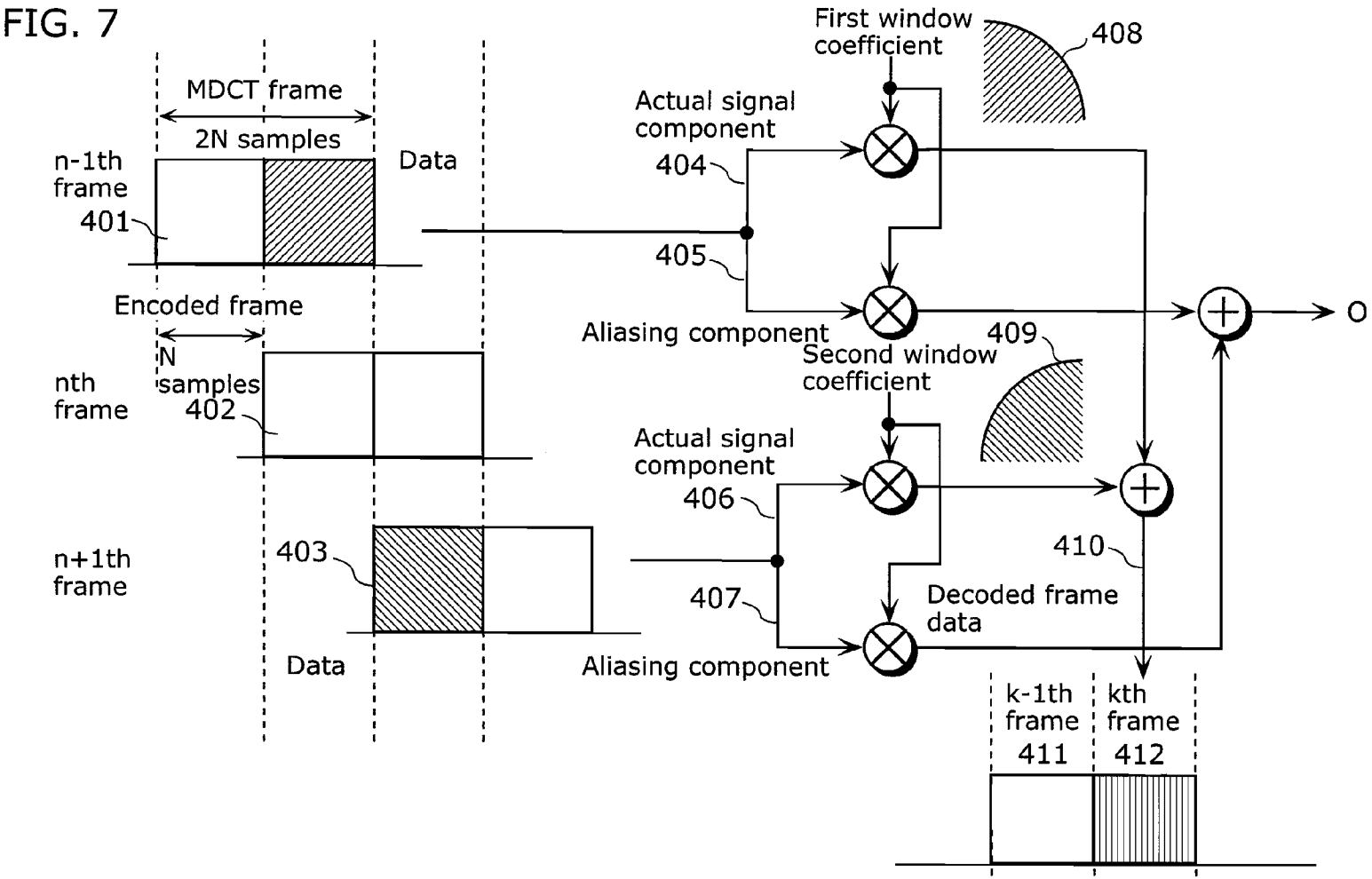
FIG. 7 is a diagram showing reproduction speed changing using MDCT window.

FIG. 7 is a diagram showing the principle of reproduction speed changing using MDCT window.

In normal MDCT inverse transformation, overlap addition is performed on the last-half of an $n-1^{th}$ MDCT frame 401 and the first-half of an $n^{th}$ MDCT frame 402. Here, however, overlap addition is performed on the last-half of an $n-1^{th}$ MDCT frame 401 and the first-half of an $n+1^{th}$ MDCT frame 403. In the same manner as in the example of the normal MDCT described earlier, an aliasing component 405 and an aliasing component 407 cancel out as a result of addition and, by the addition of an actual signal component 404 and an actual signal component 406, a frame waveform signal 410 is decoded. By assuming an encoding frame waveform signal of the $k-1^{th}$ as the frame a waveform signal 411 of the $k-1^{th}$ frame at the output-side, and the frame waveform signal 410 as the waveform signal 412 of the $k^{th}$ frame at the output-side, the reproduction speed changing process is completed.

In this process, since the waveform signal 402 of the $n^{th}$ MDCT frame is not used, the transmission and decoding of the waveform signal 402 of the $n^{th}$ MDCT frame is not required, and the processing amount when reproduction speed changing is performed becomes the same as when reproduction speed changing is not performed. In other words, changing of reproduction speed is possible without increasing the processing amount.

Here, as described using FIG. 6, in order to perform reproduction speed changing using the pitch cycle, the encoded frame length N needs to be equal to the pitch cycle L.

However, since the pitch cycle L is different depending on the state of the input audio signal, the encoded frame length N needs to be of variable-length in synchronization with the pitch cycle L.

However, normally, the encoded frame length N is fixed as a power-of-2 (for example, 512, 1024, and so on). This is because a power-of-2 samples of MDCT can be easily attained by fast transformation using FFT. Furthermore, although fast transformation can be implemented even for a frame length other than that of a power-of-2, there is a need to change transformation algorithms for each frame length, and having a variable-length in synchronization with the pitch cycle is not practical.

Therefore, waveform signals for pitch cycle L samples need to be transformed into waveform signals of a predetermined length, preferably of a number of samples N that can be denoted by a power-of-2.

The waveform modification unit 103 has a function for transforming the waveform signals for pitch cycle L samples into waveform signals of encoded frame length N samples.

Figure 8:
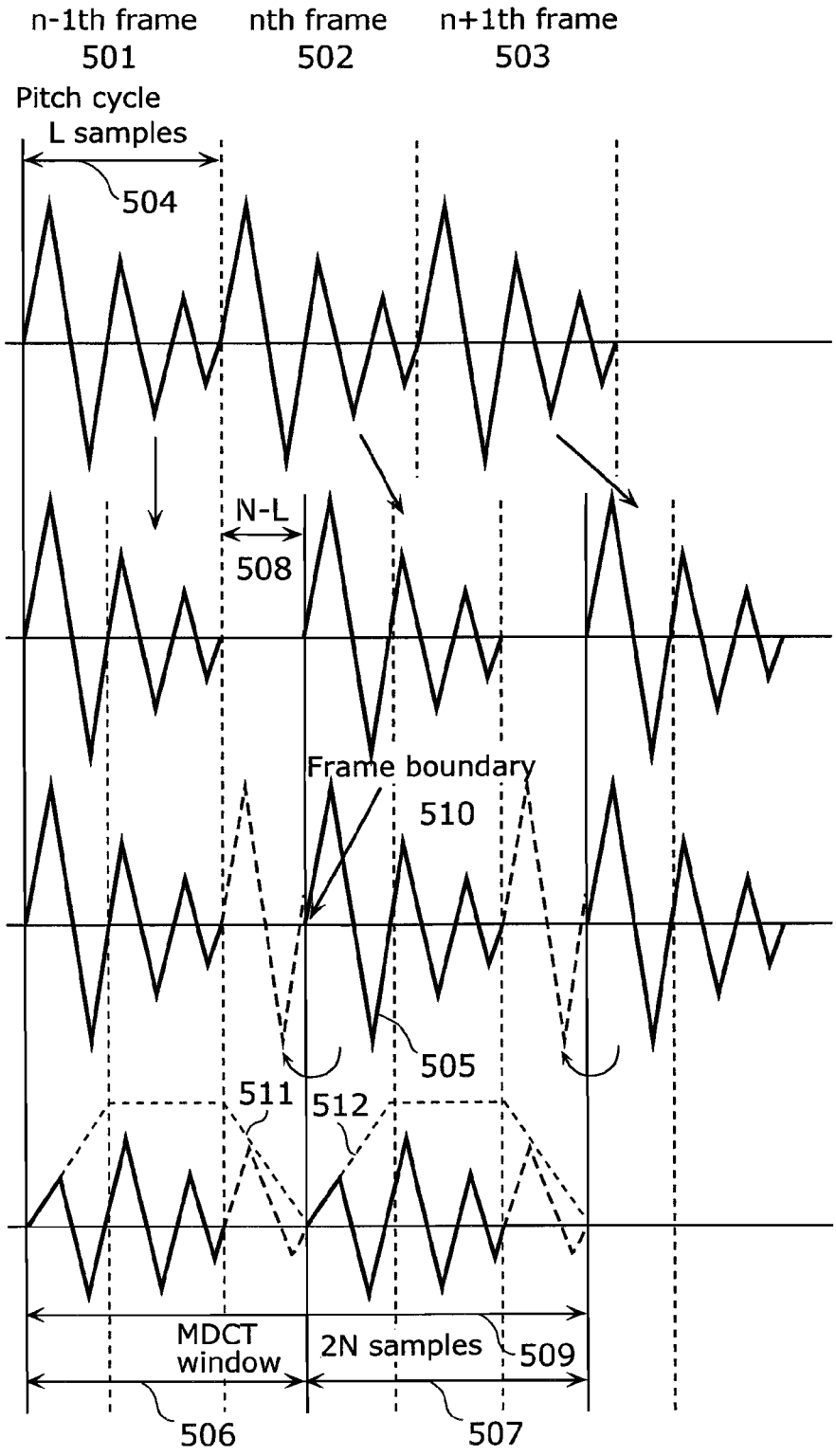
FIG. 8 is a diagram showing the waveform modification process in the encoding process.

FIG. 8 is a diagram showing an example of the operation of the waveform modification unit 103.

Waveform signals 501, 502, and 503 which correspond to the $n-1^{th}$, $n^{th}$, and $n+1^{th}$ pitch cycle frames, respectively, have lengths equal to the pitch cycle L.

In this example, L<=N is assumed.

A waveform signal divided into pitch cycle length L samples is rearranged in frames based on the encoded frame N sample length. In FIG. 8, the waveform signal 501 is arranged in a region of an encoded frame 506, and the waveform signal 502 is relocated to the region of the encoded frame 507.

At this time, when L<N, a section 508 in which a waveform signal does not exist arises. Therefore, for such portion, a waveform signal 509 for the same number of samples as the section 508 is copied from the beginning portion of the next frame.

At this time, since a discontinuity point arises in a frame boundary 510, the copied section 508 is multiplied by a reducing window 511 which becomes 0 at the frame boundary 510. At the same time, an increasing window 511 which becomes 0 at the frame boundary 510 is applied to a section 509.

When it is assumed that the reducing window 511 is r(t), the increasing window 512 is s(t), and the start position for either of the windows is t=0, the reducing window 511 and the increasing window 512 satisfy the relationship in expression (3).

[Expression 3]

$$r^2(t)+s^2(t)=1\ (0\leqq t<N-L) \quad (3)$$

By performing the pitch cycle L sample waveform signal cutting, the above-mentioned waveform signal duplication, and window multiplication in all the encoded frame boundaries, a modified waveform signal 513 is obtained.

The waveform signal 513 obtained in such manner becomes a temporal waveform having the coded frame length N as a pitch cycle, and satisfies the previously described condition for implementing reproduction speed changing using MDCT windows, and the pitch cycle=encoded frame length condition.

The modified waveform 513 is outputted as the modified MDCT frame signal 110 in FIG. 3, and is transformed by the MDCT unit 104 using an MDCT window 505 having a 2N sample length in the same manner as in the normal MDCT transformation.

Next, the operation of the waveform modification unit 604 of the decoding apparatus 20 shall be described.

Figure 9:
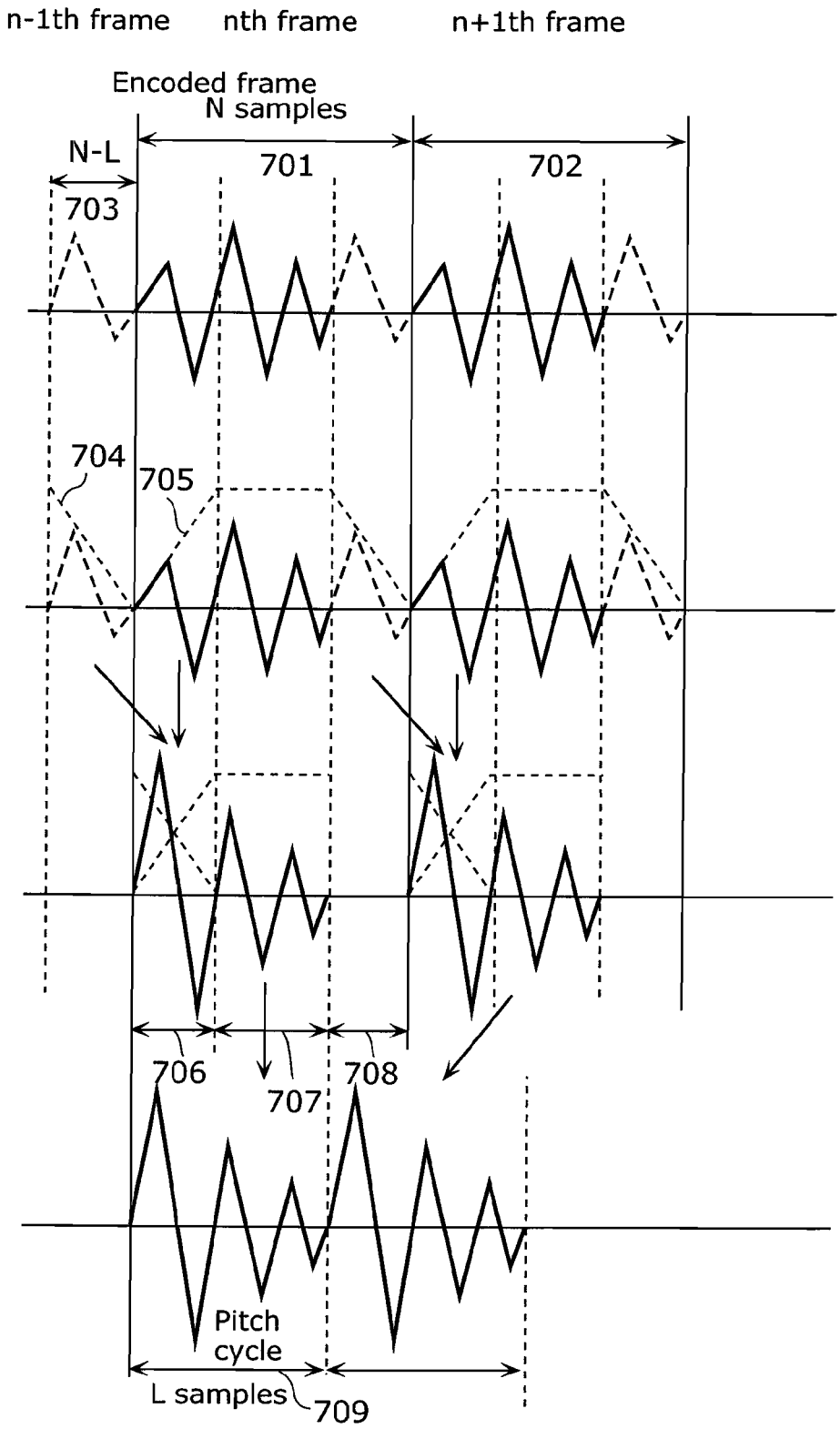
FIG. 9 is a diagram showing the waveform modification process in the decoding process.

FIG. 9 is a diagram describing the operation of the waveform modification unit 604.

In FIG. 9, 701 is a frame decoding signal of the $n^{th}$ frame, 702 is a frame decoding signal of the $n+1^{th}$ frame, and 703 is a frame decoding signal of N−L samples from the end of the $n-1^{th}$ frame. Here, N is the number of samples of the encoded frame, and L is the number of samples of the pitch cycle indicated by the pitch cycle 610.

When the frame decoding signal 701 of the $n^{th}$ frame is inputted, N−L samples from the beginning thereof is multiplied by an increasing window 705. The decoding signal 703 of the previous frame is multiplied by a decreasing window 704.

When it is assumed that the reducing window 704 is r(t) and the increasing window 705 is s(t), the reducing window 704 and the increasing window 705 satisfy the relationship in expression (4).

[Expression 4]

$$r^2(t)+s^2(t)=1 \ (0 \leqq t < N-L) \tag{4}$$

Furthermore, the reducing window 704 and the increasing window 705 are identical to the reducing window 511 and the increasing window 512, respectively, which are used in the encoding process. The respective signals which have been multiplied are then added up to generate a waveform signal of a section 706.

The inputted frame decoding signal 701 of the $n^{th}$ frame is used, as is, with respect to the waveform signal of a section 707.

The waveform signal of a section 708 is held since it is used in the decoding of the $n+1^{th}$ frame.

A signal 709 which connects the waveform signals of section 706 and section 707 becomes the modified frame decoding signal 611 which is the output of the waveform modification unit 604.

With this process, the frame decoding signal of N samples is modified into a decoding signal of L samples which are equal to the number of samples of the pitch cycle. The modified decoding signal of L samples becomes the same as the pitch waveform signal of L samples divided in the encoding process.

In the aforementioned configuration, process during uniform-speed reproduction and variable-speed reproduction in the decoding apparatus is absolutely the same.

Furthermore, the information transmission amount from the encoding apparatus 10 to the decoding apparatus 20 can be reduced to the same level as during uniform-speed reproduction, and the processing amount in the decoding apparatus 20 can be reduced to the same level as in the decoding during uniform-speed reproduction.

Note that in the case of variable-speed reproduction, for example when carrying out double-speed reproduction, the decoding process which decodes a frequency parameter may be skipped, and the audio signal reproduction speed may be changed.

Accordingly, since variable-speed reproduction becomes possible by bitstream manipulation, the processing amount required for decoding is reduced. Furthermore, sine the bitstream amount required in decoding decreases, the required transmission band during variable-speed reproduction is reduced.

Meanwhile, although the pitch cycle L is assumed to be a constant fixed value in the description thus far, in actuality, the pitch cycle is different depending on the state of the input audio signal.

Therefore, the condition for correctly performing encoding and decoding with respect to a variable pitch cycle L shall be described next.

Figure 10:
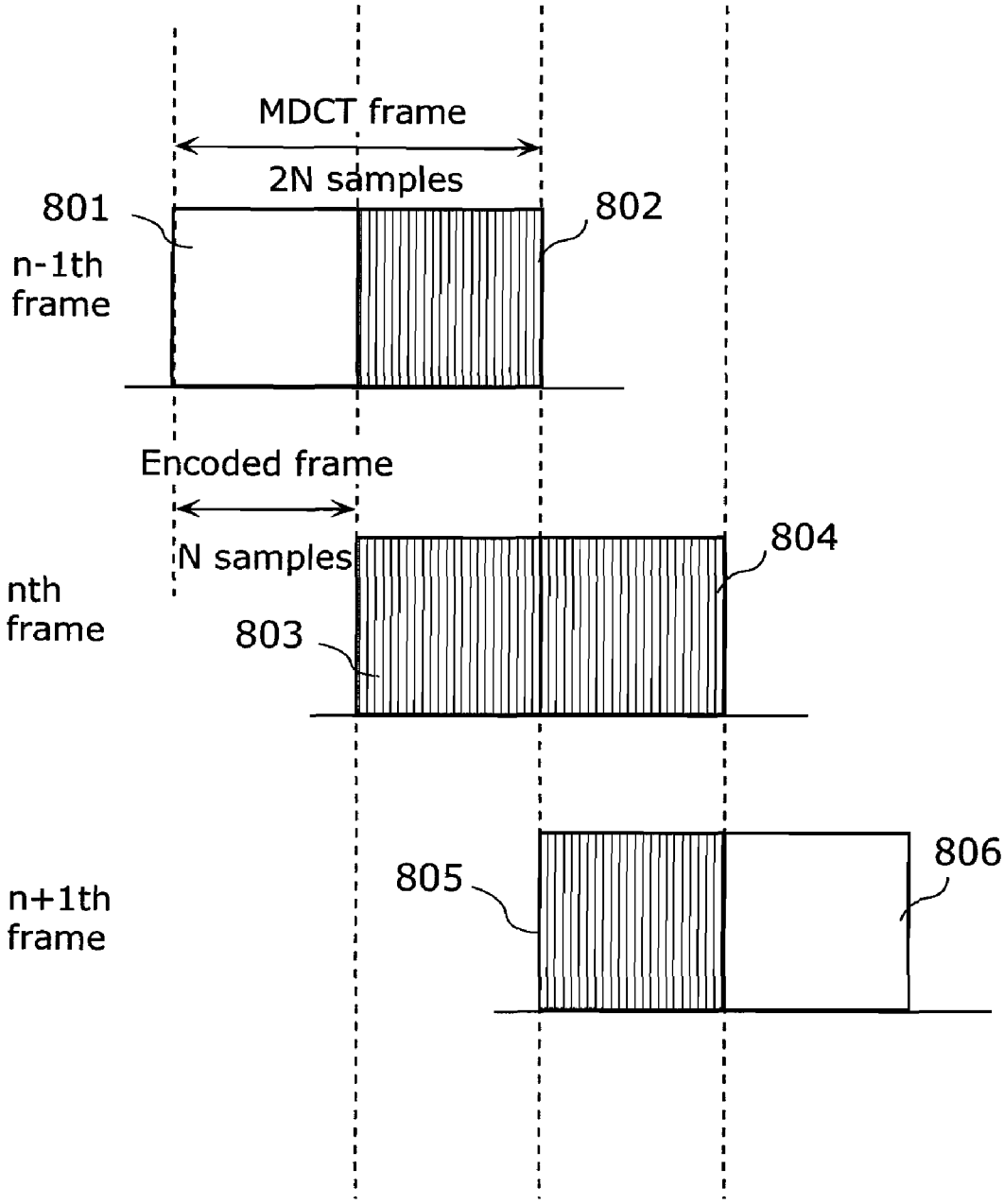
FIG. 10 is a diagram showing the relationship between encoded frames in the frame addition process.

FIG. 10 is a diagram showing the frame addition process in MDCT transformation.

In FIG. 10, 801 is the signal waveform of the first-half section of the $n-1^{th}$ MDCT frame, 802 is the waveform signal for the last-half section of the $n-1^{th}$ MDCT frame, 803 is the signal waveform of the first-half section of the $n^{th}$ MDCT frame, 804 is the waveform signal for the last-half section of the $n-1^{th}$ MDCT frame, 805 is the signal waveform of the first-half section of the $n+1^{th}$ MDCT frame, and 806 is the waveform signal for the last-half section of the $n+1^{th}$ MDCT frame.

In the case where reproduction speed changing is not performed, sections 802 and 803, as well as sections 804 and 805 are added up. In contrast, in the case where reproduction speed changing is performed and the $n^{th}$ MDCT frame is skipped, section 802 and section 805 are added up.

In the decoding process, since the pitch cycles of the two sections that are added up must be the same, it is necessary for the pitch cycles that are set for section 802 and section 805 to be the same. This indicates that, at the same time, the pitch cycles that are set for section 803 and section 804 in the $n^{th}$ frame must be identical.

On the contrary, when the pitch cycles of section 803 and section 804 are different, the pitch cycles of section 802 and section 805 are necessarily different, and addition between both is not possible. By setting identical pitch cycles for section 803 and section 804, information indication identical pitch cycles are multiplexed in the respective bitstreams corresponding to the $n^{th}$ coded frame and the $n+1^{th}$ coded frame.

Note that for a MDCT frame for which frame skipping is not permitted, the pitch cycles of the first-half section and the last-half section may be different. For example, the pitch cycles of section 801 and section 802 (=section 803) may be different and, in such case, information indicating respectively different pitch cycles are multiplexed in the respective bitstreams corresponding to the $n-1^{th}$ coded frame and the $n^{th}$ coded frame.

In order to implement arbitrary reproduction speed changing by MDCT frame skipping, MDCT frames that can be skipped must exist at a frequency stipulated according to a request condition. As previously described, in order to generate a skippable MDCT frame, equal pitch cycles may be set in the first-half section and the last-half section. However, there are many instances where the pitch cycles detected from an input audio signal are different for each section.

In order to solve this problem, it is possible to adjust the pitch cycles detected from the input audio signal, and treat it as if the first-half section and the last-half section of one MDCT frame are of equal pitch cycles.

Figure 11:
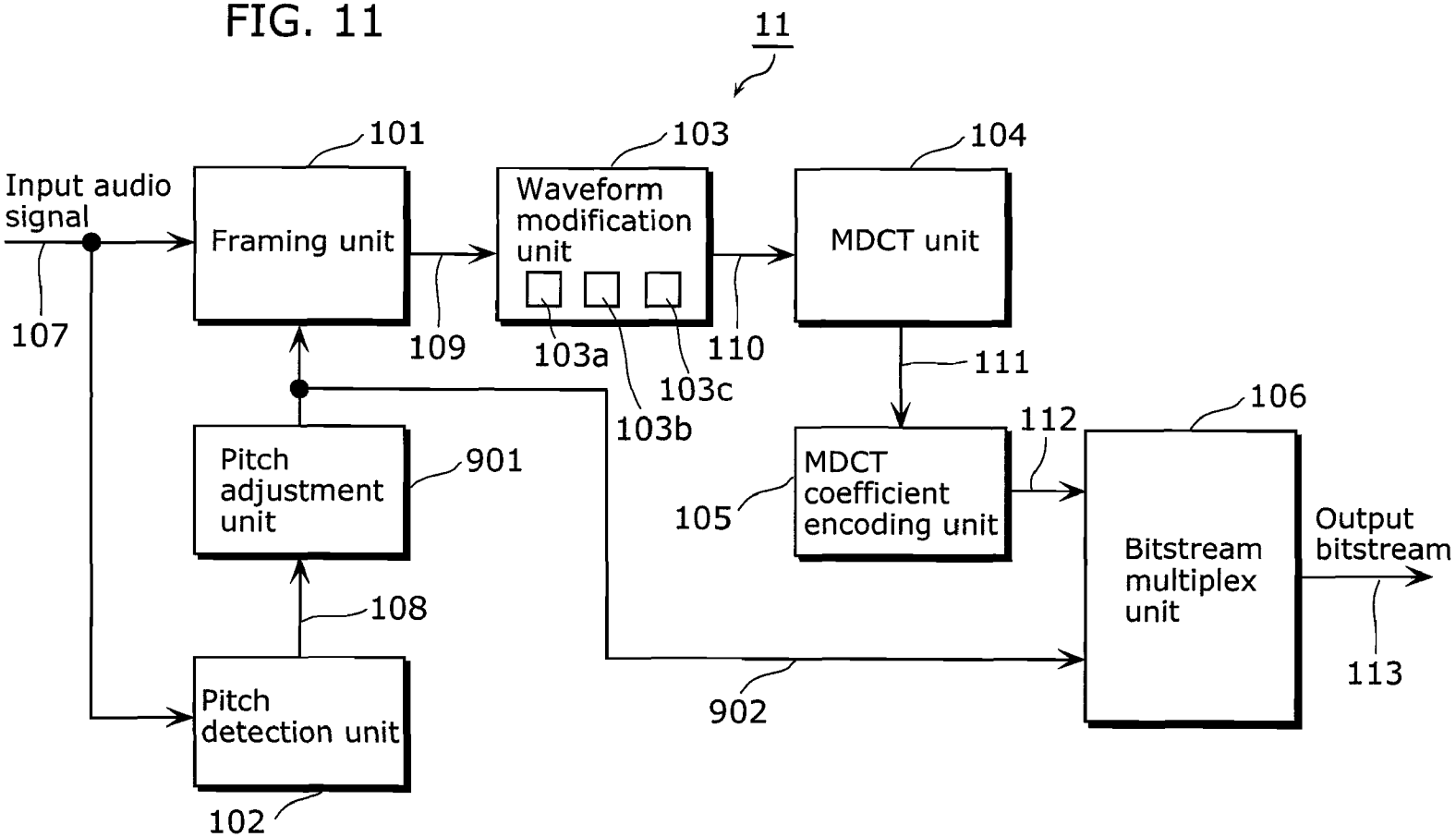
FIG. 11 is a diagram showing the configuration of the audio encoding apparatus of the present invention.

FIG. 11 is a function block diagram showing the configuration of an encoding apparatus 11.

In contrast to the encoding apparatus 10 of the present invention shown in FIG. 3, the encoding apparatus 11 is added with a pitch adjustment unit 901, and is configured to input an adjusted pitch cycle 902 in place of the pitch cycle 108, to the framing unit 101 and the bitstream multiplex unit 106.

The pitch adjustment unit 901 sets an identical pitch cycle for two adjacent coded frames, at a predetermined frequency, while referring to the inputted pitch cycle 108, and outputs this as the adjusted pitch cycle 902.

As a method for adjusting the pitch cycle, there is a method, among others, in which the average value of the respective pitch cycles of two adjacent coded frames is taken, and the obtained average pitch cycle is adopted as a common pitch cycle for the two adjacent coded frames.

The process after the adjusted pitch cycle 902 is inputted to the framing unit 101 is the same as in the process described using FIG. 3. By adopting such a configuration, it is possible to set MDCT frames which permit skipping at a predetermined arbitrary frequency and, as a result, arbitrary reproduction speed changing can be implemented.

Note that although the above description uses an example in which the pitch waveform signal for one cycle is arranged in one coded frame, it should be obvious that a pitch waveform signal for 2 or more cycles can be considered and used as a pitch waveform signal for one new cycle.

In this configuration, an even number of pitch waveform signals are included in one MDCT frame of 2N samples.

Second Embodiment

In the encoding and decoding apparatuses of the present invention, the relationship of the coded frame length N and the pitch cycle L is important.

For example, in the case where the L>N relationship is upheld, application with the technique in the first embodiment is not possible. Furthermore, when L becomes extremely small in relation to N, overlapping sections increase relatively, triggering the decrease in encoding efficiency.

In order to solve this problem, the second embodiment shows a configuration that can be applied even in the case where L>N or an odd number of the pitch waveform signal exists in the MDCT frame of 2N samples.

Figure 12:
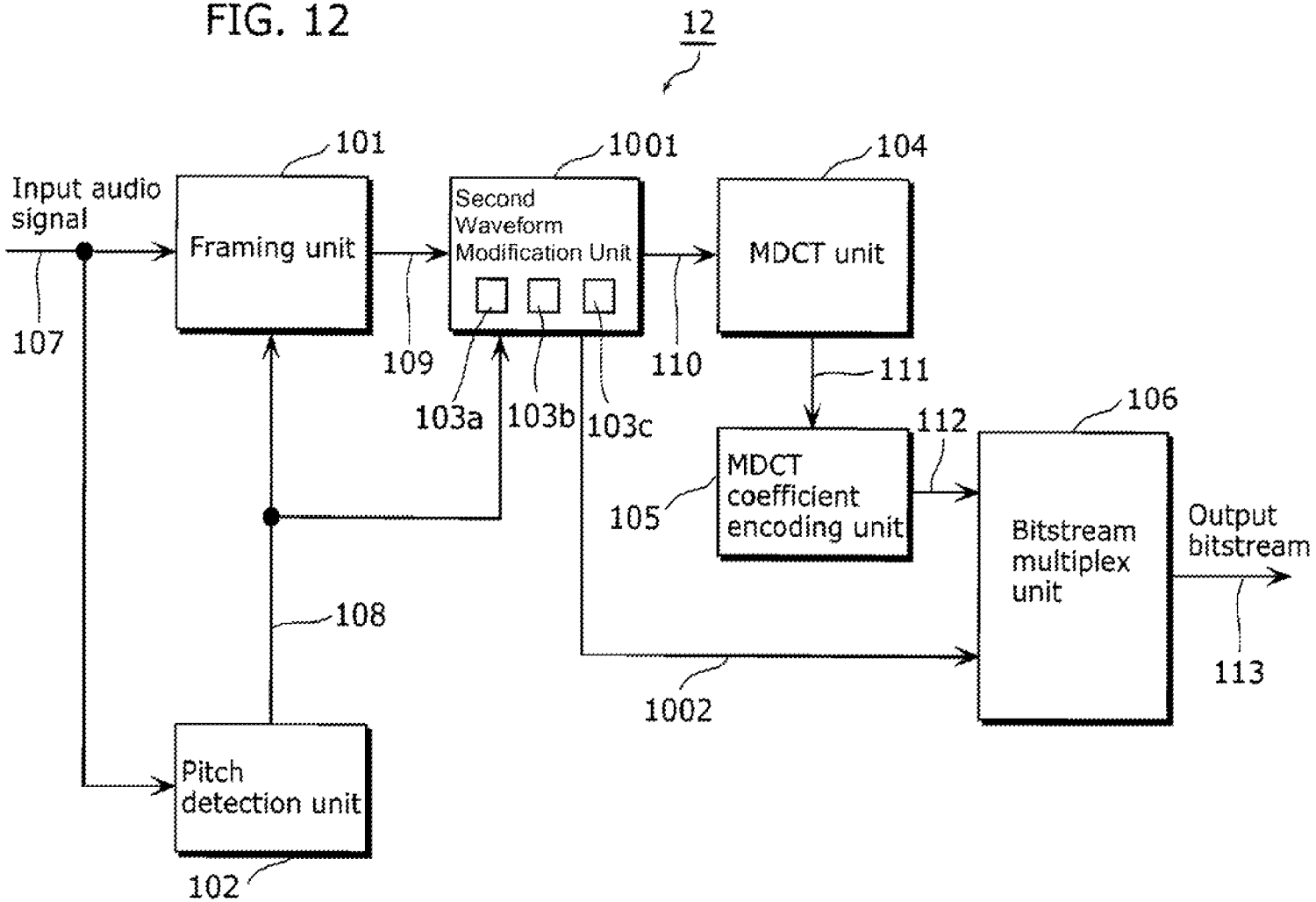
FIG. 12 is a diagram showing the configuration of the audio encoding apparatus of the present invention.

FIG. 12 is a function block diagram showing the configuration of an encoding apparatus 12 related to the second embodiment.

In contrast to the configuration of the encoding apparatus 10 shown in FIG. 3, the encoding apparatus 12 includes a second waveform modification unit 1001 in place of the waveform modification unit 103, and is configured in such a way that the pitch cycle 108 is inputted to the second waveform modification unit 1001, and a second pitch cycle 1002 which is newly generated by the waveform modification unit 1001 is inputted to the bitstream multiplex unit 106.

Figure 13:
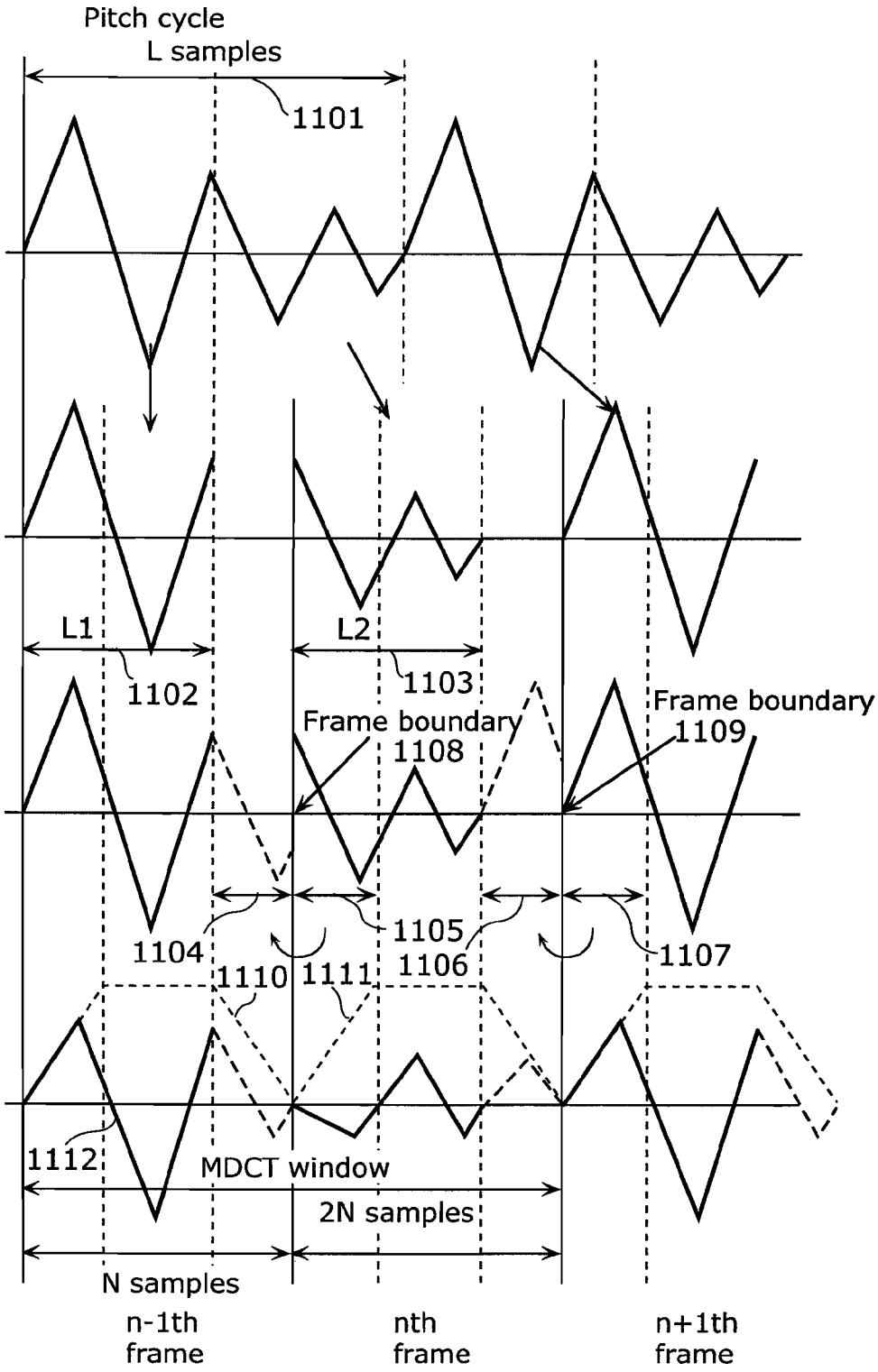
FIG. 13 is a diagram showing the waveform modification process in the encoding process.

FIG. 13 is a diagram showing the operation of the waveform modification unit 1001 in the second embodiment.

A pitch waveform signal 1101 is divided into two wave signals 1102 and 1103 becoming L1<=N, and L2<=N respectively. The number of samples of L1 and L2 are arbitrary, and may be identical or different.

For a section 1104 of N−L1 samples, the waveform signal of a section 1105 is duplicated. In the same manner, for a section 1106 of N−L1 samples, the waveform signal of a section 1107 is duplicated. At this time, coded frame boundaries 1108 and 1109 are discontinuity points.

In order to eliminate these discontinuity points, for example, the copied section 1104 is multiplied by a reducing window 1110 which becomes 0 in a frame boundary. Furthermore, section 1105 which is the copy source is likewise multiplied with an increasing window 1111 which becomes 0 in the frame boundary. The same processing is performed on sections 1106 and 1107 which precede and follow the discontinuity point 1109, respectively.

With the abovementioned modification process, the pitch waveform signal 1101 of L samples is modified into a waveform signal 1112 corresponding to MDCT frames of 2N samples. The waveform signal 1112 is outputted as the modified MDCT frame signal 110, and is encoded after undergoing MDCT transformation. Furthermore, as a second pitch cycle 1002, each of L1 and L2 is outputted as a pitch cycle corresponding to their respective encoded frames. The encoded MDCT coefficient and the second pitch cycle information are multiplexed by the bitstream multiplex unit 106.

After modification in the above-mentioned manner, the encoded waveform signal 1112 can be decoded with the same process as in the decoding apparatus described in the first embodiment, as long as reproduction speed changing is not performed. In other words, the same decoding apparatus can be used in relation to the encoding apparatuses in the first embodiment and the second embodiment. Furthermore, even when reproduction speed changing is performed, only the MDCT frame skipping method is different, and it is possible to have the same decoding apparatus.

Figure 14:
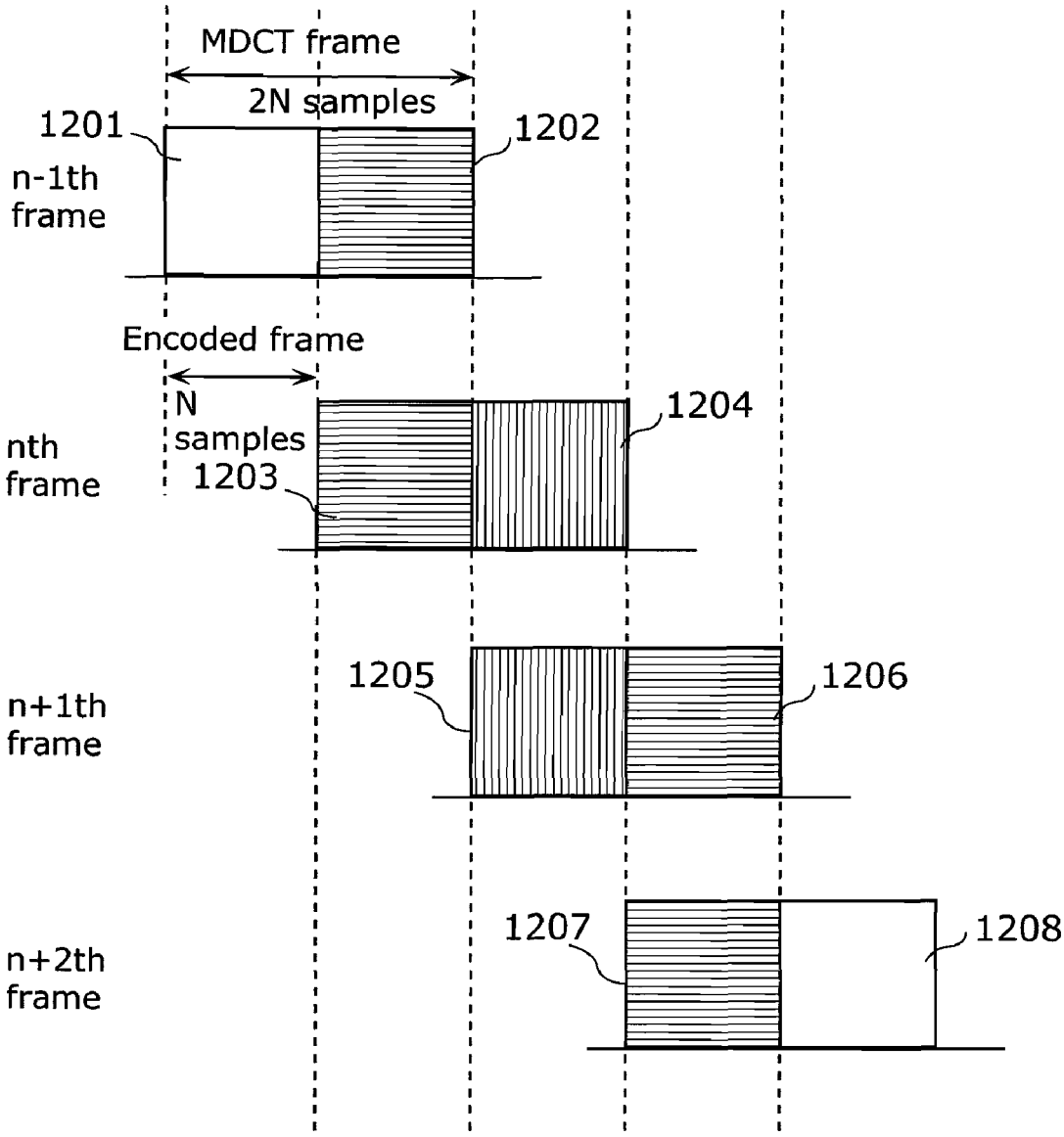
FIG. 14 is a diagram showing the relationship between encoded frames in the frame addition process.

FIG. 14 is a diagram describing the reproduction speed changing through MDCT frame skipping in a bitstream encoded using the encoding apparatus in the second embodiment.

In the first embodiment, the waveform signal within the MDCT frame is a signal having, as a cycle, the encoded frame length N samples. In contrast, in the second embodiment, the waveform signal within the MDCT frame is a signal having, as a cycle, the encoded frame length 2N samples. In this case, when looking at a waveform signal on a per encoded frame basis, the same pattern appears every other frame. In other words, in FIG. 14, although the added section for section 1202 during normal transformation is section 1203, a pattern which is the same as in section 1203 appears in section 1207 in the $n+2^{th}$ MDCT frame. Therefore, in order to implement reproduction speed changing using MDCT frame skipping, it is possible to skip two MDCT frames, the nth and n+1th, in order to add section 1203 and section 1207.

Moreover, although in this configuration, it is not possible to handle a pitch cycle in which L>2N, by setting a sufficiently large value for N, problems will not occur from a practical standpoint. For example, by assuming N=1024 samples, the smallest pitch cycle that cannot be handled is 2049 samples. Although, in a 48 kHz sampling signal, this is equivalent to about 23.4 Hz, it is rare for a general music or speech signal to have such a long pitch cycle.

Moreover, as in the first embodiment, in the second embodiment, it is also possible to have a pitch adjustment unit 901, and perform framing and waveform modification using the adjusted pitch cycle.

By adopting such a configuration, it is possible to set MDCT frames which permit skipping at a predetermined arbitrary frequency and, as a result, arbitrary reproduction speed changing can be implemented.

Commonality is possible between the encoding apparatus in the first embodiment and the encoding apparatus in the second embodiment. In other words, it is possible to provide a third waveform modification unit having the functions of both the waveform modification unit 103 and the second waveform modification unit 1001 and, according to the number of pitch waveform signals existing in the MDCT frame, switch between the function of the waveform modification unit 103 and the second waveform modification unit 1001 in the case of even numbers and odd numbers, respectively.

Here, the pitch cycle used by the waveform modification unit 103 and the pitch cycle 1002 used by the second waveform modification unit 1001 are information with both indicate lengths from 0 to N samples and, as encoded information, can be handled as exactly the same information. Therefore, in the case where the function of the waveform modification unit 103 is selected, the inputted pitch cycle 108 or the adjusted pitch cycle 902 may be outputted, as is, as the second pitch cycle 1002. With this configuration, no matter what pitch cycle an input audio signal has, the appropriate encoding process can be performed and encoding efficiency can be increased.

Note that although, in the descriptions of all the aforementioned waveform modification units, the divided pitch waveform signals are arranged to match the beginning of each encoded frame boundary, the arrangement of the divided waveform signals is arbitrary. In other words, for the signalless sections arising before or after a pitch waveform signal arranged in an arbitrary position within each encoded frame, a signal of the encoded frame length may be generated by duplicating the waveform signal of sections which would normally be continuous, from pitch waveform signals arranged in the respective preceding or subsequent frames. The length of reducing windows and increasing windows used in window multiplication, in the encoded frame boundary, is N−L where, regardless of the pitch waveform signal arrangement, the length of the coded frame is N and the pitch cycle is L. The difference of the arrangements of the divided pitch waveform signals in the encoding apparatus only appears as a difference in the phases of the encoded audio signal, and does not have any influence on the configuration or processing in the decoding apparatus.

Third Embodiment

Figure 15:
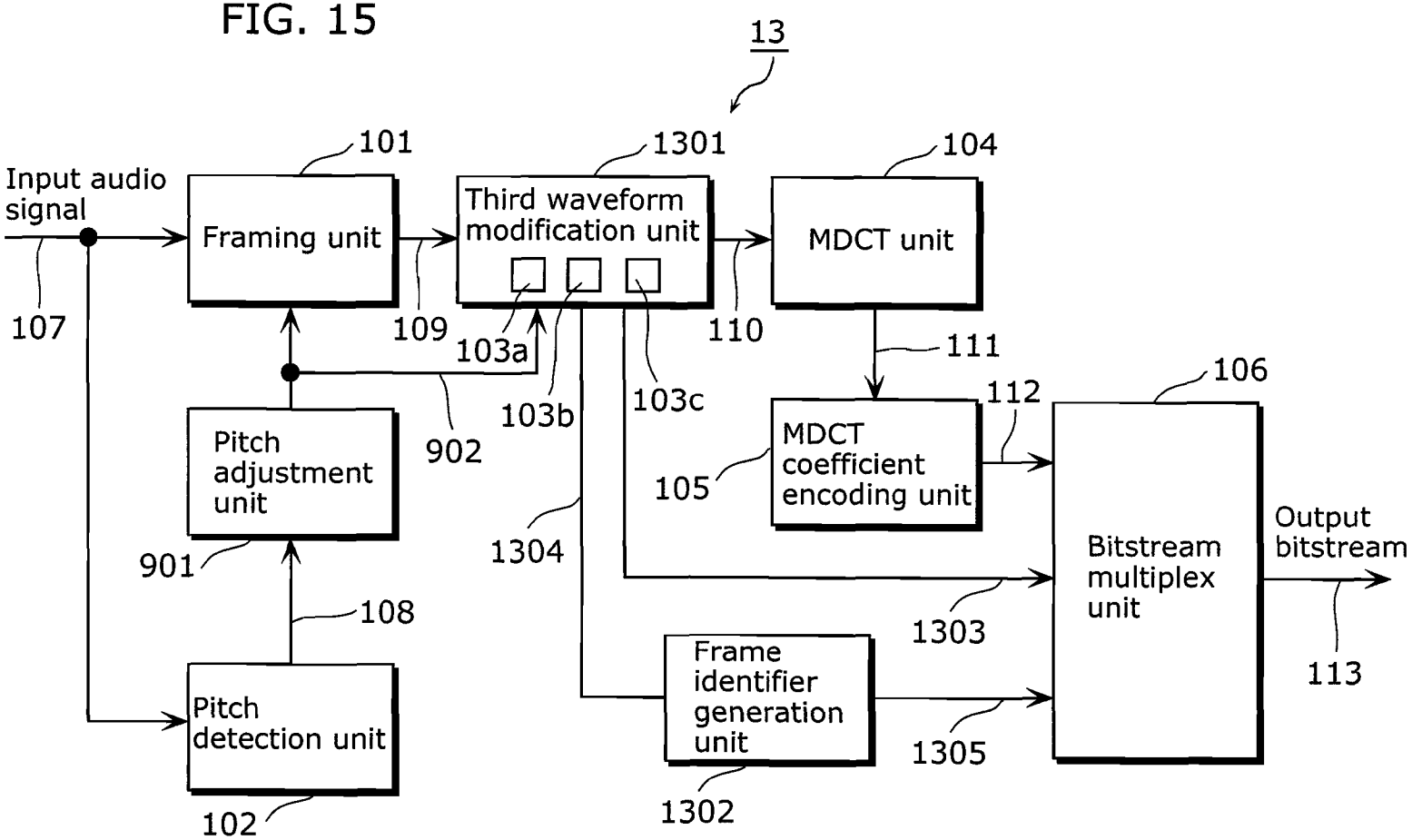
FIG. 15 is a diagram showing the configuration of the audio encoding apparatus of the present invention.

FIG. 15 is a diagram showing the configuration of the audio encoding apparatus in the third embodiment.

As shown in FIG. 15, in contrast to the encoding apparatus 11 in FIG. 11, an encoding apparatus 13 is different in terms of being provided with a third waveform modification unit 1301 in place of the waveform modification unit 103, and inputting the adjusted pitch cycle 902 to the third waveform modification unit 1301; being provided with a new frame identifier generation unit 1302, and generating a frame identifier 1305 based on frame skip information outputted from the third waveform modification unit 1301; and inputting a second pitch cycle 1303, outputted by the third waveform modification unit 1301, and the frame identifier 1305 to the bitstream multiplex unit 106.

The frame skip information 1304, the frame identifier 1305 which are additional functions in the present configuration, and the operation of the third waveform modification unit 1301 and the frame identifier generation unit 1302 are described hereafter.

The third waveform modification unit 1301 detects the number of pitch waveform signals included within one MDCT frame based on inputted pitch information, as well as an encoded frame that can be skipped based on the uniformity of pitch cycles between two or more adjacent frames.

As previously described, in the case where the number of pitch signals included in one MDCT frame is an even number, it is possible to independently skip one encoded frame. Furthermore, in the case where the number of pitch signals included in one MDCT frame is an odd number, it is possible to skip two successive encoded frames as a set.

Therefore, the frame skip information includes the following two information:

(A) Whether or not the current encoded frame is a frame that can be skipped; and (B) Whether the number of pitch waveform signals included in the MDCT frame is an even number or an odd number.

The frame identification generation unit 1302 generates, based on the frame skip information 1304, the frame identifier 1305 which is added to the current frame.

The frame identifier to be generated may be any identifier as long as it is possible to differentiate the following three:

(1) An unskippable encoded frame.

(2) Skippable, and the number of pitch waveform signals included in the MDCT frame is an even number.

(3) Skippable, and the number of pitch waveform signals included in the MDCT frame is an odd number.

As an example, it is possible to have frame identifiers by setting "0" for the condition (1), "1" for the condition (2), and "2" for condition (3).

Figure 16:
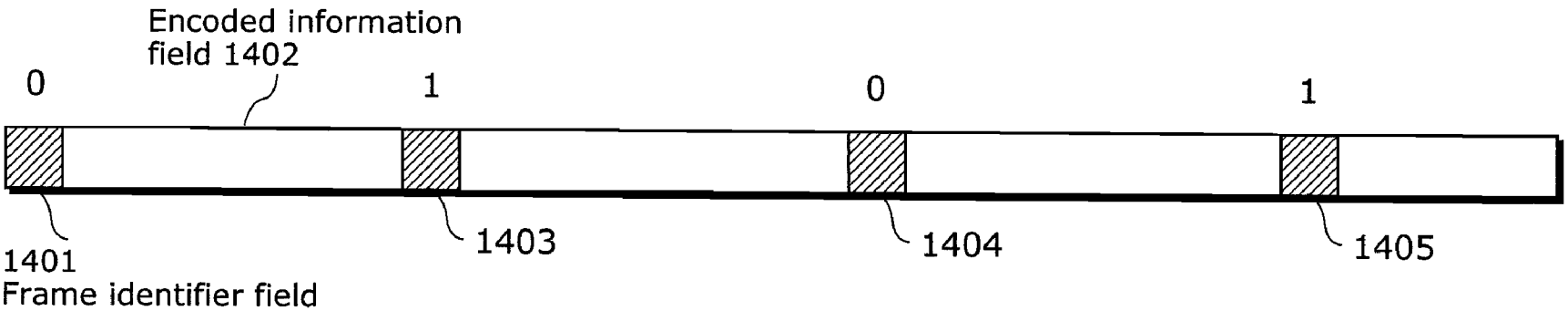
FIG. 16 is a diagram showing the configuration of a bitstream.

FIG. 16 shows an example of a bitstream with which the frame identifier 1305 is multiplexed. As frame identifiers, "0" and "1" are provided.

A frame identifier field 1401 and an encoded information field 1402 are arranged in a bitstream of the $n^{th}$ encoded frame. The frame identifier 1305 is written in the frame identifier field 1401, and an MDCT encoded information 112 and a pitch cycle 1303 are written in the encoded information field. Since a frame identifier "1" indicates that it is possible to independently skip an encoded frame, frame identifiers "0" and "1" can exist alternately, as shown in FIG. 16.

Figure 17:
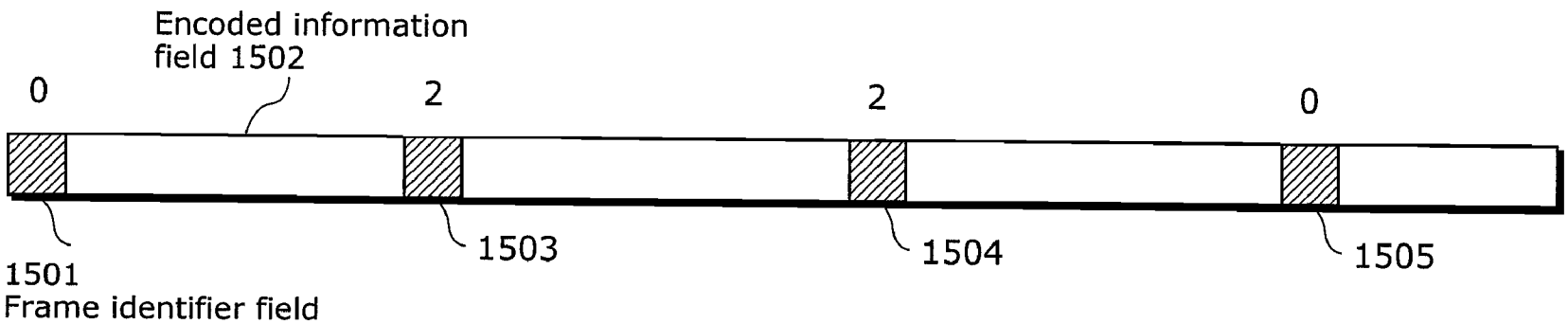
FIG. 17 is a diagram showing the configuration of a bitstream.

FIG. 17 shows an example of a bitstream with which the frame identifier 1305 is multiplexed. As frame identifiers, "0" and "1" are provided.

Since a frame identifier "2" indicates that two successive encoded frames can be skipped, the frame identifier 2 is written in frame identifier field 1503 and 1504 of two successive encoded fields.

Note that an identifier corresponding to condition (3) can be further segmentized. In other words, between two successive encoded frames, it is possible to assign a frame identifier "2" for the preceding encoded frame, and a frame identifier "3" to the succeeding encoded frame. By attaching such frame identifiers, there is the advantage of being able to judge immediately whether or not skipping is possible even in cases where reproduction is performed from mid-stream of a bitstream.

Furthermore, it is also possible to limit the types of the frame identifier to be used. For example, when frame skipping is not to be allowed in the case where condition (3) is satisfied, the required identifiers become only those corresponding to conditions (1) and (2), and the amount of information required for describing the frame identifiers can be reduced.

Note that although in FIG. 16 and FIG. 17 the frame identifier fields are arranged at the beginning of the bitstream for each encoded frame, the positions are arbitrary.

Fourth Embodiment

Figure 18:
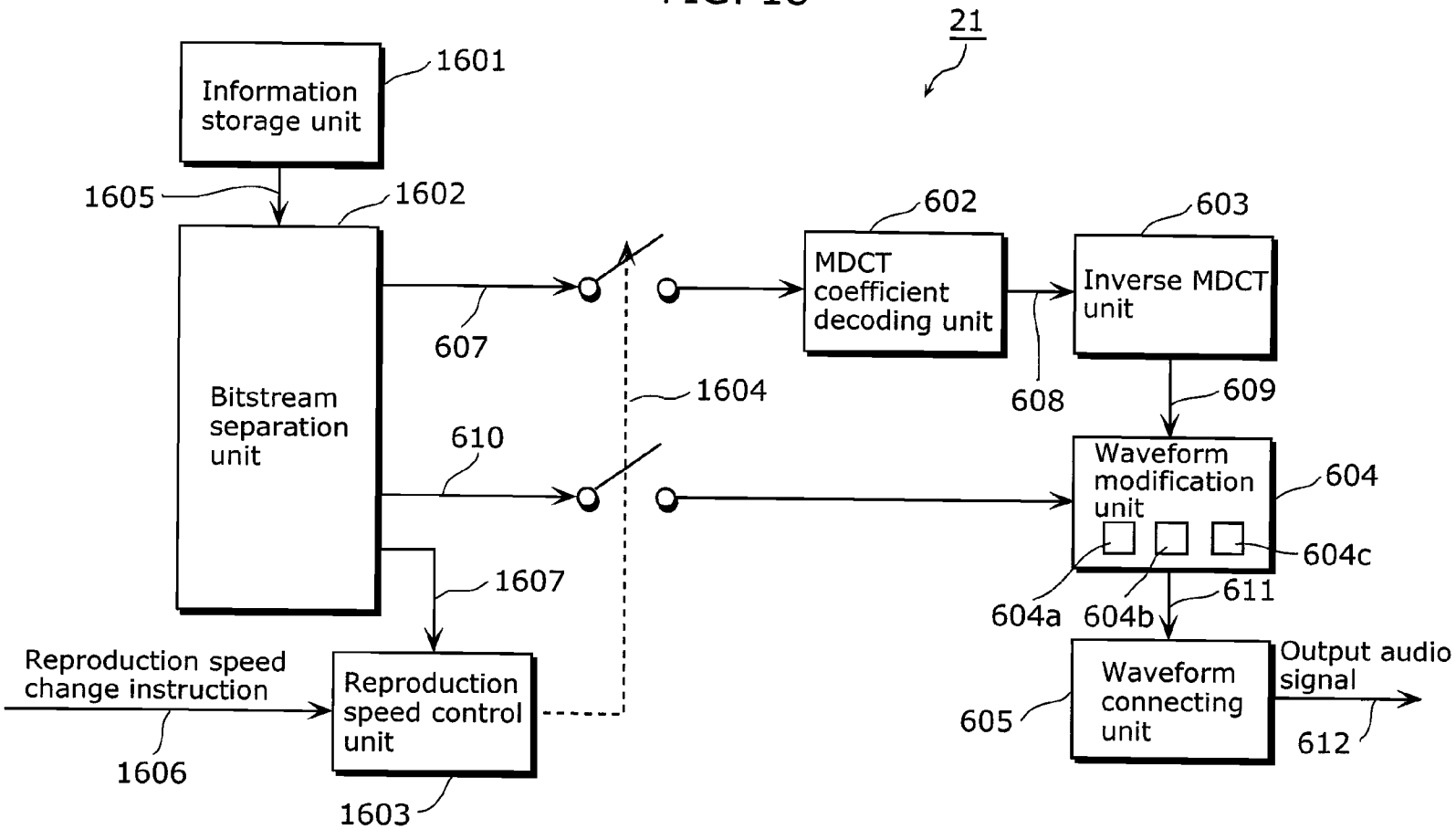
FIG. 18 is a diagram showing the configuration of the audio decoding apparatus of the present invention.

FIG. 18 is a function block diagram showing the configuration of the decoding apparatus 21 in the fourth embodiment of the present invention.

A bitstream encoded by the encoding apparatus according to the third embodiment of the present invention, for example, is stored in an information storage unit 1601 of the decoding apparatus 21. An optical disc, a magnetic disc, a semiconductor memory can be used as the information storage unit 1601. A bitstream 1605, which is read by the storage unit 1601, is separated by a bitstream separation unit 1602 into the MDCT code 607, the pitch cycle 610, and a frame identifier 1607.

In accordance with an externally provided reproduction speed change instruction 1606, a reproduction speed control unit 1603 calculates the frame skipping frequency required in order to implement the instructed reproduction speed. For example, a frame skipping frequency f required in order to obtain a reproduction speed of k-times is represented by expression (5).

[Expression 5]

$$k = \frac{\text{total number of frames}}{\text{number of encoded frames}} \tag{5}$$

$$f = \frac{\text{number of skipped frame}}{\text{total number of frames}} = \frac{(\text{total number of frames} - \text{number of encoded frames})}{\text{total number of frames}} = \frac{1.0 - 1.0}{k}$$

For example, in order to implement double speed, k=2.0 is substituted into the formula and f=0.5 is obtained, and thus 50 percent of the total number of frames are to be skipped.

The reproduction speed control unit 1603 refers to the frame identifier 1607 and skips the encoded frames for which frame skipping is possible, based on the calculated frame skipping frequency f. Specifically, with respect to an encoded frame for which it is judged that frame skipping is to be performed, the reproduction speed control unit controls a switch 1604 and shuts off the transmission of the MDCT code 607 and the pitch cycle 610.

The process from the MDCT coefficient decoding unit 602 to the waveform connecting unit 605 is the same process as that in the decoding apparatus of the present invention previously described using FIG. 4. An output audio signal 612 for which reproduction speed has been changed is outputted from the waveform connecting unit 605.

Note that in the above description, it is also possible to provide the reproduction speed control unit 1603 with a function for adjusting the frame skipping frequency f with reference to the pitch cycle 610. In the decoding apparatus of the present invention, the temporal length of the frame decoding signal 611, which is in an encoded frame basis, is dependent on the pitch cycle 610 set for that encoded frame. Normally, since pitch cycles change smoothly, the change in pitch cycles between adjacent encoded frames is small, and as a condition, a relationship of a number 5 holds true. However, in a section in which the change of pitch cycles is great, a mismatch arises between the frame skipping frequency f calculated from the number 5 and the actual frame skipping frequency f. In order to correct this mismatch, the reproduction speed control unit 1603 may refer to the pitch cycle 610 and calculate the correct encoding signal temporal length for each encoded frame, and adjust the frame skipping frequency f based on the result.

Figure 19:
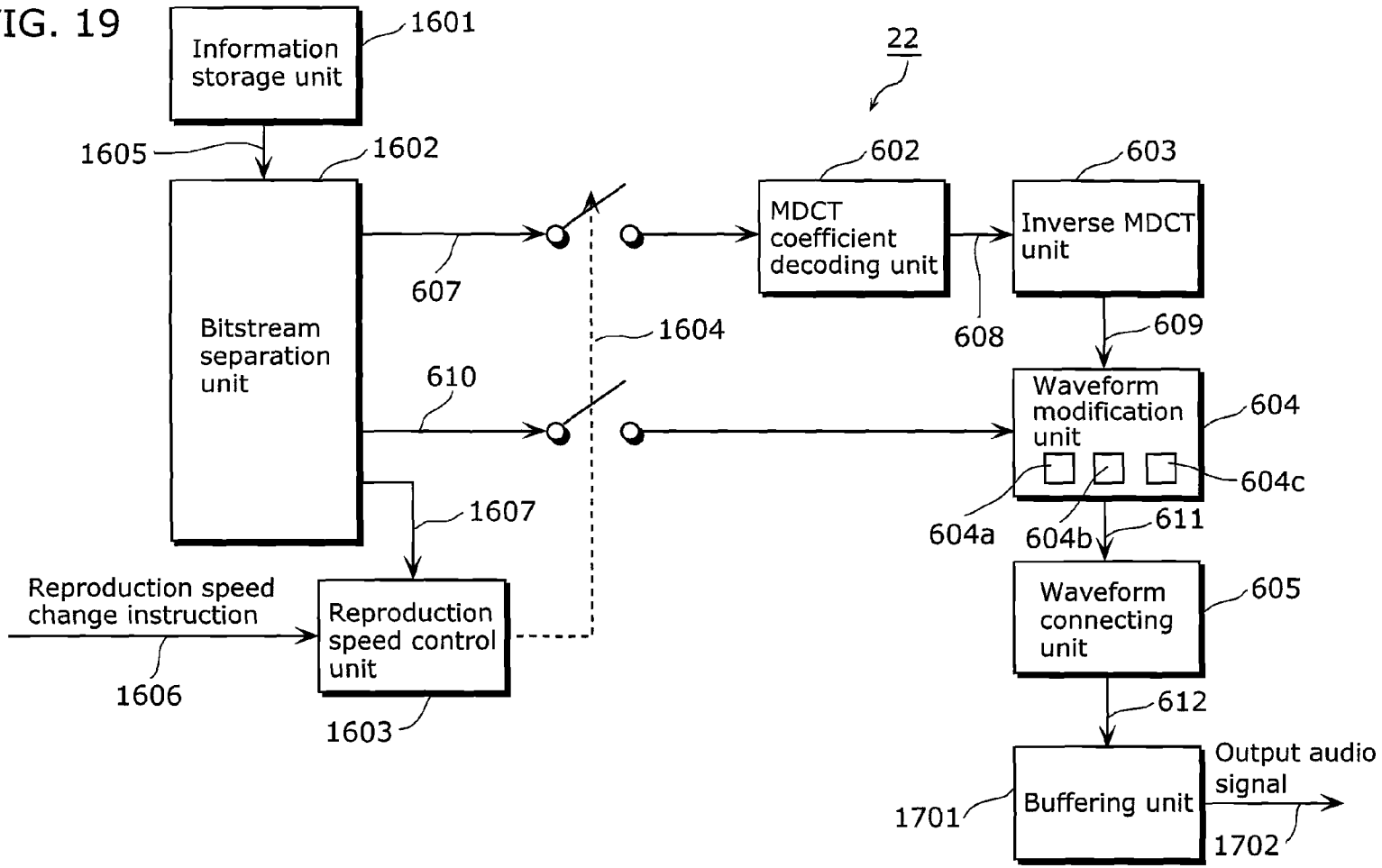
FIG. 19 is a diagram showing the configuration of the audio decoding apparatus of the present invention.

Note that, as shown in FIG. 19, the output of the waveform connecting unit 605 may also be outputted as a decoded audio signal of a fixed frame length, after once being held in a buffering unit 1701.

As previously described, in the decoding apparatus of the present invention, the temporal length of the frame decoding signal 611, which is in an encoded frame basis, is dependent on the pitch cycle 610 set for that encoded frame. Therefore, the number of temporal samples of the output audio signal 612 also varies. Consequently, by accumulating the output decoding signal once in the buffering unit 1701, and outputting it as an audio signal of a fixed sample length in a predetermined constant interval, an output audio signal 1702 of a fixed frame length can be obtained. By having a fixed frame length for the output audio signal, there is the advantage that output audio signal handling becomes easy.

Fifth Embodiment

Figure 20:
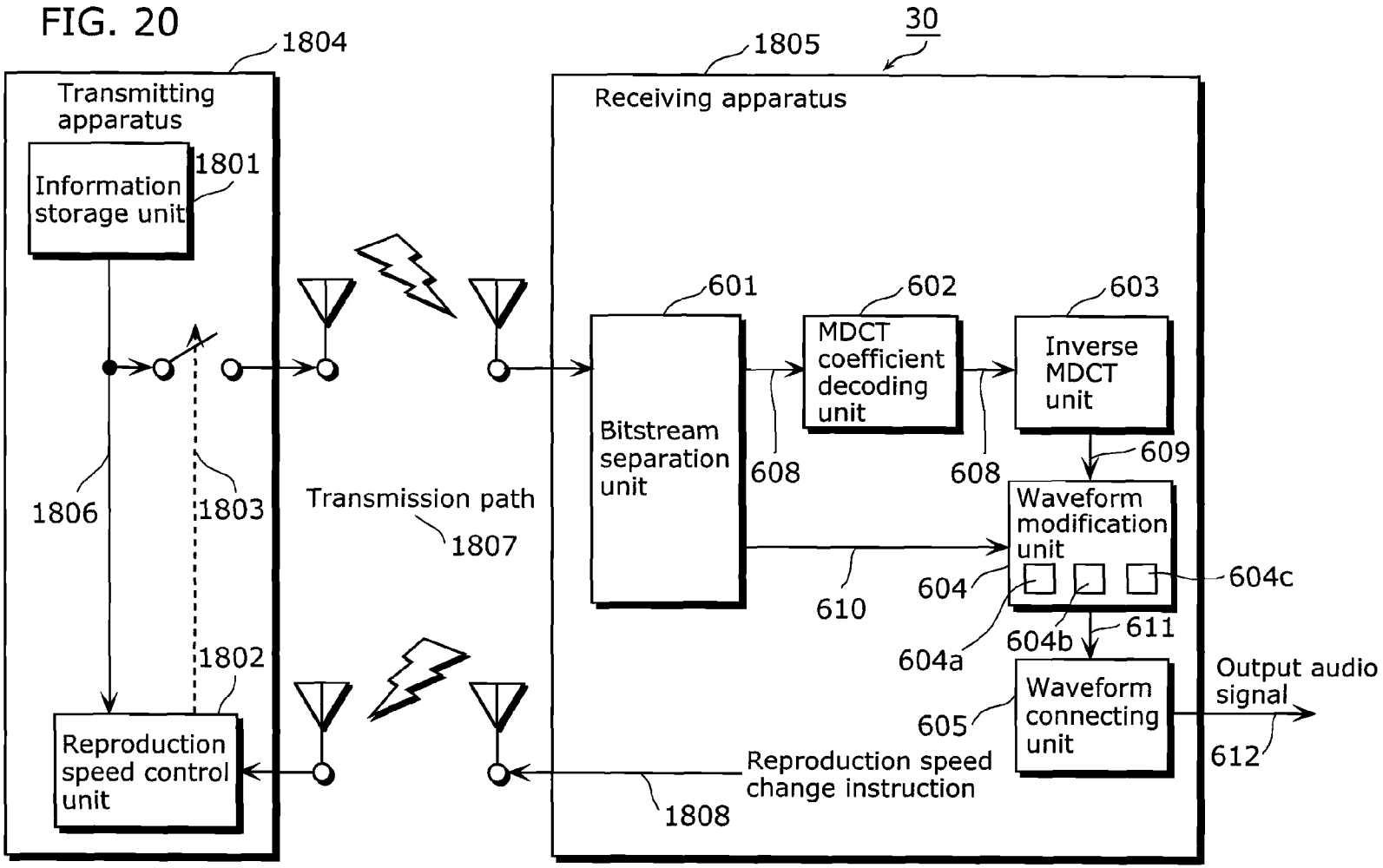
FIG. 20 is a diagram showing the configuration of the audio encoded information transmitting apparatus of the present invention.

FIG. 20 is a diagram showing the configuration of the audio encoded information transmitting apparatus in the fifth embodiment of the present invention.

In the present configuration, a transmitting apparatus 1804 including: an information storage unit 1801; a reproduction speed control unit 1802; and a switch 1803, and a receiving apparatus 1805 including: the bitstream separation unit 601; the MDCT coefficient decoding unit 602; the inverse MDCT unit 603, the waveform modification unit 604, and the waveform connecting unit 605 are connected via a transmission path 1807.

The configuration and the operation of the receiving apparatus 1805 is the same as the decoding apparatus shown using FIG. 4.

A bitstream encoded by the encoding apparatus according to the third embodiment of the present invention, for example, is stored in the information storage unit 1801.

A reproduction speed change instruction 1808 is sent to the transmitting apparatus 1804 via the transmission path 1807.

In accordance with the reproduction speed change instruction 1808, the reproduction speed control unit 1802 controls the switch 1803 while referring to frame identifier information, or frame identifier information and pitch cycle information, included in a bitstream 1806 read from the information storage unit 1801. Details of the operation of the reproduction speed control unit 1802 are the same as the operation of the reproduction speed control unit 1603 explained in the fourth embodiment of the present invention.

The switch 1803 turns the transmission of the bitstream 1806 ON/OFF on a per encoded frame basis. A bitstream passing the switch 1803 is inputted to the receiving apparatus 1805 via the transmission path 1807, as an input bitstream 1809.

In the decoding apparatus in the present configuration, all the processes related to reproduction speed changing are completed in the transmitting apparatus 1804. With this, in the receiving apparatus, none of the processes relating to reproduction speed changing are necessary and there is no increase in processing amount due to the performance of reproduction speed changing.

Furthermore, since, with the switch 1803, only the bitstream of the encoded frames corresponding to the output audio signal for which reproduction speed has been changed, the amount of information per unit of time for the bitstream transmitted via the transmission path 1807 becomes almost equal to that when reproduction speed changing is not performed. In other words, reproduction speed changing can be performed without increasing the amount of transmission information per unit of time.

Note that, for the transmission path 1807, any transmission protocol may be used regardless of whether it is wired or wireless, as long as the reproduction speed change instruction 1808 and the bitstream 1809 can be transmitted.

(Variations)

Note that although the present invention is described based on the above-mentioned embodiments, it should be obvious that the present invention is not limited to such above-mentioned embodiments. The present invention also includes such cases as described below.

(1) Each of the above-described apparatuses is a computer system specifically made from a microprocessor, a ROM, a RAM, a hard disk unit, a display unit, a keyboard, and a mouse. A computer program is stored in the RAM or the hard disk unit. Each apparatus accomplishes its function through the operation of the microprocessor in accordance with the computer program. Here, the computer program is configured by combining plural command codes indicating instructions to the computer in order to accomplish predetermined functions.

(2) It is possible that a part or all of the constituent elements making up each of the above-mentioned apparatuses is made from one system LSI (Large Scale Integration circuit). The system LSI is a super multi-function LSI that is manufactured by integrating plural components in one chip, and is specifically a computer system which is configured by including a microprocessor, a ROM, a RAM, and so on. A computer program is stored in the RAM. The system LSI accomplishes its functions through the operation of the microprocessor in accordance with the computer program.

(3) It is possible that a part or all of the constituent elements making up each of the above-mentioned apparatuses is made from an IC card that can be attached to/detached from each apparatus, or a stand-alone module. The IC card or the module is a computer system made from a microprocessor, a ROM, a RAM, and so on. The IC card or the module may include the super multi-function LSI. The IC card or the module accomplishes its functions through the operation of the microprocessor in accordance with the computer program. The IC card or the module may also be tamper-resistant.

(4) The present invention may also be the methods described thus far. The present invention may also be a computer program for executing such methods through a computer, or as a digital signal made from the computer program.

Furthermore, the present invention may be a computer-readable recording medium, such as a flexible disk, a hard disk, a CD-ROM, an MO, a DVD, a DVD-ROM, a DVD-RAM, a BD (Blu-ray Disc), or a semiconductor memory, on which the computer program or the digital signal is recorded. In addition, the present invention may also be the digital signal recorded on such recording mediums.

Furthermore, the present invention may also transmit the computer program or the digital signal via an electrical communication line, a wireless or wired communication line, a network represented by the Internet, a data broadcast, and so on.

Furthermore, it is also possible that the present invention is a computer system including a microprocessor and a memory, with the aforementioned computer program being stored in the memory and the microprocessor operating in accordance with the computer program.

Furthermore, the present invention may also be implemented in another independent computer system by recording the program or digital signal on the recording medium and transferring the recording medium, or by transferring the program or the digital signal via the network, and the like.

(5) It is also possible to combine the above-described embodiments and the aforementioned variations.

Industrial Applicability

The present invention can be generally applied to an apparatus, for example devices such as a cellular phone and a music player, which retrieves a compression-encoded sound or audio signal, from a storage medium or via a transmission path, and decodes these into the original sound or audio signal while changing the reproduction speed. The present invention is specifically suited for an sound/music player having an optical disc, magnetic disk, semiconductor memory, and the like, as a storage medium, and for on-demand delivery of voice/music/video, and so on.

The invention claimed is:

1. An audio encoding apparatus for encoding an audio signal, said audio encoding apparatus comprising:

a pitch cycle detection unit operable to detect a pitch cycle of an audio signal;

a framing unit operable to frame the audio signal based on the detected pitch cycle;

a first waveform modification unit operable to perform waveform modification on the framed audio signal, in conformance with a time-frequency transformation frame length, and to output a waveform-modified audio signal;

a time-frequency transformation unit operable to transform the waveform-modified audio signal into a frequency parameter, for every predetermined time-frequency transformation frame length;

an encoding unit operable to encode the frequency parameter; and a multiplex unit operable to multiplex the encoded frequency parameter from said encoding unit and the pitch cycle, and to output the multiplexed result as a bit stream, wherein said first waveform modification unit includes:

a first cutting unit operable to cut the framed audio signal in conformance with the pitch cycle; and a first duplication unit operable to duplicate part of a waveform signal of a pitch cycle of an adjacent encoded frame in between a waveform signal of a pitch cycle of a current encoded frame and the waveform signal of the pitch cycle of the adjacent encoded frame, so as to generate the waveform-modified audio signal of the time-frequency transformation frame length.

2. The audio encoding apparatus according to claim 1, wherein said first waveform modification unit further includes a first windowing unit operable to perform windowing so that a discontinuity point does not occur in the waveform-modified audio signal of the time-frequency transformation frame length generated by said first duplication unit, and said first windowing unit is operable to generate, before and after an encoded frame boundary which is a possible discontinuity point, a reducing window and an increasing window which are of (N−L) sample length, where a length of an encoded frame is N samples and a length of a pitch waveform signal arranged in the encoded frame is L samples, and to multiply an end portion of a temporally preceding encoded frame by the reducing window, and to multiply a beginning portion of a succeeding encoded frame by the increasing window.

3. The audio encoding apparatus according to claim 1, wherein the waveform-modified audio signal transformed by said time-frequency transformation unit includes an even number of pitch waveform signals.

4. The audio encoding apparatus according to claim 1, wherein the waveform-modified audio signal transformed by said time-frequency transformation unit includes an odd number of pitch waveform signals.

5. The audio encoding apparatus according to claim 1, wherein said time-frequency transformation unit is a modified discrete cosine transform (MDCT) unit, and the frequency parameter is a MDCT coefficient.

6. The audio encoding apparatus according to claim 1, further comprising a frame identifier generation unit operable to judge whether or not encoded frame skipping is possible based on the pitch cycle and a number of pitch waveform signals included in the waveform-modified audio signal of the time-frequency transformation frame length, and to generate a frame identifier according to a result of the judgment, wherein said multiplex unit is operable to multiplex the generated frame identifier into the bit stream.

7. An audio decoding apparatus including: a decoding unit which decodes a frequency parameter of an encoded frame included in an inputted bit stream; and an inverse time-frequency transformation unit which performs inverse time-frequency transformation, for every predetermined time-frequency transformation frame length, so as to inverse-transform the frequency parameter into an audio signal, wherein the bit stream includes pitch cycle information indicating a pitch cycle of the audio signal, and the inverse time-frequency-transformed audio signal is an audio signal which has been framed in advance based on the pitch cycle, and which has been waveform-modified in conformance with the time-frequency transformation frame length, and waveform-modified in conformance with the time-frequency transformation frame length by duplicating part of a waveform signal of a pitch cycle of an adjacent encoded frame in between a waveform signal of a pitch cycle of a current encoded frame and the waveform signal of the pitch cycle of the adjacent encoded frame, said audio decoding apparatus comprising:

a bit stream separation unit operable to separate the pitch cycle information included in the inputted bit stream;

a second waveform modification unit operable to modify the audio signal of the time-frequency transformation frame length into a waveform signal of a pitch cycle length, based on the pitch cycle information; and a waveform connecting unit operable to connect audio signals modified to the pitch cycle length by said second waveform modification unit, wherein said second waveform modification unit is operable to modify the current encoded frame, which is the audio signal of the time-frequency transformation frame length, into the waveform signal of the pitch cycle length by adding (i) the part of the waveform signal of the pitch cycle of the adjacent encoded frame, which has been duplicated in between the waveform signal of the pitch cycle of the current encoded frame and the waveform signal of the pitch cycle of the adjacent encoded frame, and (ii) part of the waveform signal of the pitch cycle of the current encoded frame.

8. The audio decoding apparatus according to claim 7, wherein the waveform signal of the time-frequency transformation frame length is subjected to windowing which generates, before and after an encoded frame boundary which is a possible discontinuity point, a reducing window and an increasing window which are of (N−L) sample length, where a length of an encoded frame is N samples and a length of a pitch waveform signal arranged in the encoded frame is L samples, and multiplies an end portion of a temporally preceding encoded frame by the reducing window, and multiplies a beginning portion of a succeeding encoded frame by the increasing window, and said second waveform modification unit (i) further includes a second windowing unit operable to generate, before and after the encoded frame boundary which is a possible discontinuity point, the reducing window and the increasing window which are of (N−L) sample length, and to multiply an end portion of a temporally preceding encoded frame by the reducing window, and to multiply a beginning portion of a succeeding encoded frame by the increasing window, and (ii) is operable to add the end portion multiplied by the reducing window and the beginning portion multiplied by the increasing window.

9. The audio decoding apparatus according to claim 7, further comprising a first reproduction speed changing unit operable to change a reproduction speed of an audio signal by skipping a decoding process of decoding the frequency parameter.

10. The audio decoding apparatus according to claim 7, comprising:

a switch unit operable to turn on and off transmission of the frequency parameter and the pitch cycle; and a second reproduction speed changing unit operable to control said switch unit based on an instruction for reproduction speed changing and a frame identifier included in the bit stream, wherein said second reproduction speed changing unit is operable to change the reproduction speed by turning off the transmission of the frequency parameter and the pitch cycle.

11. The audio decoding apparatus according to claim 7, comprising:

a switch unit operable to turn on and off transmission of the frequency parameter and the pitch cycle; and a third reproduction speed changing unit operable to control said switch unit based on an instruction for reproduction speed changing as well as the pitch cycle and a frame identifier included in the bit stream, wherein said third reproduction speed changing unit is operable to change the reproduction speed by turning off the transmission of the frequency parameter and the pitch cycle.

12. The audio decoding apparatus according to claim 7, wherein said inverse time-frequency transformation unit is an inverse modified discrete cosine transform (MDCT) unit, and the frequency parameter is a MDCT coefficient.

13. An audio encoded information transmitting apparatus comprising: a transmitting apparatus for transmitting a bit stream of an encoded audio signal; and a receiving apparatus including a decoding unit and an inverse time-frequency transformation unit, said decoding unit receiving the bit stream of the encoded audio signal and decoding a frequency parameter of an encoded frame included in the inputted bit stream, and said inverse time-frequency transformation unit performing inverse time-frequency transformation, for every predetermined time-frequency transformation frame length, so as to inverse-transform the frequency parameter into an audio signal, wherein said transmitting apparatus includes:

an information storage unit operable to hold the bit stream of the encoded audio signal;

a switch unit operable to turn on and off transmission of the bit stream; and a fourth reproduction speed changing unit operable to control said switch unit based on an instruction for reproduction speed changing and a frame identifier included in the bit stream, the bit stream includes pitch cycle information indicating a pitch cycle of the audio signal, the inverse time-frequency transformed audio signal is an audio signal which has been framed in advance based on the pitch cycle, and which has been waveform-modified in conformance with the time-frequency transformation frame length, and waveform-modified in conformance with the time-frequency transformation frame length by duplicating part of a waveform signal of a pitch cycle of an adjacent encoded frame in between a waveform signal of a pitch cycle of a current encoded frame and the waveform signal of the pitch cycle of the adjacent encoded frame, said receiving apparatus includes:

a bit stream separation unit operable to separate the pitch cycle information included in an input bit stream;

a second waveform modification unit operable to modify the audio signal of the time-frequency transformation frame length into a waveform signal of a pitch cycle length, based on the pitch cycle information; and a waveform connecting unit operable to connect modified audio signals of the pitch cycle length from said second waveform modification unit, and said second waveform modification unit is operable to modify the current encoded frame, which is the audio signal of the time-frequency transformation frame length, into the waveform signal of the pitch cycle length by adding (i) the part of the waveform signal of the pitch cycle of the adjacent encoded frame, which has been duplicated in between the waveform signal of the pitch cycle of the current encoded frame and the waveform signal of the pitch cycle of the adjacent encoded frame, and (ii) part of the waveform signal of the pitch cycle of the current encoded frame.

14. The audio encoded information transmitting apparatus according to claim 13, wherein the waveform signal of the time-frequency transformation frame length is subjected to windowing which generates, before and after an encoded frame boundary which is a possible discontinuity point, a reducing window and an increasing window which are of (N−L) sample length, where a length of an encoded frame is N samples and a length of a pitch waveform signal arranged in the encoded frame is L samples, and multiplies an end portion of a temporally preceding encoded frame by the reducing window, and multiplies a beginning portion of a succeeding encoded frame by the increasing window, and said second waveform modification unit (i) further includes a second windowing unit operable to generate, before and after the encoded frame boundary which is a possible discontinuity point, the reducing window and the increasing window which are of (N−L) sample length, and to multiply an end portion of a temporally preceding encoded frame by the reducing window, and to multiply a beginning portion of a succeeding encoded frame by the increasing window, and (ii) is operable to add the end portion multiplied by the reducing window and the beginning portion multiplied by the increasing window.

15. The audio encoded information transmitting apparatus according to claim 13, wherein said fourth reproduction speed changing unit is operable to control said switch unit with reference to the pitch cycle information in addition to the frame identifier.

16. An audio encoding method of encoding an audio signal, said audio encoding method comprising:

a pitch cycle detection step of detecting a pitch cycle of an audio signal;

a framing step of framing the audio signal based on the detected pitch cycle;

a first waveform modification step of performing waveform modification on the framed audio signal, in conformance with a time-frequency transformation frame length;

a transformation step of transforming the waveform-modified audio signal into a frequency parameter, for every predetermined time-frequency transformation frame length;

an encoding step of encoding the frequency parameter; and a multiplex step of multiplexing the encoded frequency parameter from said encoding step and the pitch cycle, and outputting the multiplexed result as a bit stream, wherein said first waveform modification step includes:

a first cutting step of cutting the framed audio signal in conformance with the pitch cycle; and a first duplication step of duplicating part of a waveform signal of a pitch cycle of an adjacent encoded frame in between a waveform signal of a pitch cycle of a current encoded frame and the waveform signal of the pitch cycle of the adjacent encoded frame, so as to generate the waveform-modified audio signal of the time-frequency transformation frame length.

17. A non-transitory computer readable storage medium having stored thereon a program for causing a computer to execute the steps included in said audio encoding method according to claim 16.

18. An audio decoding method including: a decoding step of decoding a frequency parameter of an encoded frame included in an inputted bit stream; and an inverse time-frequency transformation step of performing inverse time-frequency transformation, for every predetermined time-frequency transformation frame length, so as to inverse-transform the frequency parameter into an audio signal, wherein the bit stream includes pitch cycle information indicating a pitch cycle of the audio signal, and the inverse time-frequency transformed audio signal is an audio signal which has been framed in advance based on the pitch cycle, and which has been waveform-modified in conformance with the time-frequency transformation frame length, and waveform-modified in conformance with the time-frequency transformation frame length by duplicating part of a waveform signal of a pitch cycle of an adjacent encoded frame in between a waveform signal of a pitch cycle of a current encoded frame and the waveform signal of the pitch cycle of the adjacent encoded frame, said audio decoding method comprises: comprising:

a bit stream separation step of separating the pitch cycle information included in the input bit stream;

a second waveform modification step of modifying the audio signal of the time-frequency transformation frame length into a waveform signal of a pitch cycle length, based on the pitch cycle information; and a waveform connecting step of connecting modified audio signals of the pitch cycle length from said second waveform modification step, wherein said second waveform modification step comprises modifying the current encoded frame, which is the audio signal of the time-frequency transformation frame length, into the waveform signal of the pitch cycle length by adding (i) the part of the waveform signal of the pitch cycle of the adjacent encoded frame, which has been duplicated in between the waveform signal of the pitch cycle of the current encoded frame and the waveform signal of the pitch cycle of the adjacent encoded frame, and (ii) part of the waveform signal of the pitch cycle of the current encoded frame.

19. A non-transitory computer readable storage medium having stored thereon a program for causing a computer to execute the steps included in said audio decoding method according to claim 18.

* * * * *

UNITED STATES PATENT AND TRADEMARK OFFICE

CERTIFICATE OF CORRECTION

PATENT NO. : 7,974,837 B2
APPLICATION NO. : 11/993395
DATED : July 5, 2011
INVENTOR(S) : Naoya Tanaka It is certified that error appears in the above-identified patent and that said Letters Patent is hereby corrected as shown below:

IN THE CLAIMS

In column 24, line 61, claim 18, please replace “comprises: comprising:” with --comprising:--.

Signed and Sealed this
First Day of May, 2012

David J. Kappos

David J. Kappos
*Director of the United States Patent and Trademark Office*